US006389982B1

(12) United States Patent
Evensen

(10) Patent No.: US 6,389,982 B1
(45) Date of Patent: May 21, 2002

(54) TRANSPORT SYSTEM

(75) Inventor: Jan E. Evensen, Sandefjord (NO)

(73) Assignee: Skyway Transport Systems A.S., Sandefjord (NO)

( * ) Notice: Subject to any disclaimer, the term of this patent is extended or adjusted under 35 U.S.C. 154(b) by 0 days.

(21) Appl. No.: 09/601,984

(22) PCT Filed: Feb. 10, 1999

(86) PCT No.: PCT/NO99/00046

§ 371 Date: Aug. 10, 2000

§ 102(e) Date: Aug. 10, 2000

(87) PCT Pub. No.: WO99/43528

PCT Pub. Date: Sep. 2, 1999

(30) Foreign Application Priority Data

Feb. 11, 1998 (NO) ..... 19980581

(51) Int. Cl.[7] ..... B61B 3/02
(52) U.S. Cl. ..... 104/124; 104/242
(58) Field of Search ..... 104/242, 243, 104/247, 124; 105/72.2, 215.1, 215.2

(56) References Cited

U.S. PATENT DOCUMENTS

| | | | | | |
|---|---|---|---|---|---|
| 456,438 | A | * | 7/1891 | Shaw | 104/242 |
| 469,371 | A | * | 2/1892 | Ferren | 104/243 |
| 1,380,732 | A | | 6/1921 | Miller | |
| 3,590,743 | A | | 7/1971 | Larson | |
| 3,628,462 | A | | 12/1971 | Holt | |
| 3,913,491 | A | | 10/1975 | Auer, Jr. et al. | |
| 4,027,596 | A | * | 6/1977 | Nardozzi, Jr. | 104/138 R |
| 4,539,162 | A | * | 9/1985 | Ferrell | 261/1 |
| 4,930,591 | A | * | 6/1990 | Lanius et al. | 180/65.1 |
| 5,020,446 | A | | 6/1991 | Potthoff | |
| 5,282,426 | A | | 2/1994 | Canner | |

FOREIGN PATENT DOCUMENTS

| | | | | |
|---|---|---|---|---|
| DE | 2263568 | | 7/1973 | |
| DE | 2605595 | A1 | 9/1976 | |
| EP | 0116021 | A1 | 8/1984 | |
| FR | 2610883 | A2 * | 8/1988 | B60V/3/04 |
| GB | 1208900 | | 10/1970 | |
| GB | 1354638 | * | 5/1974 | |
| GB | 1511910 | | 5/1978 | |

* cited by examiner

*Primary Examiner*—S. Joseph Morano
*Assistant Examiner*—Frantz F. Jules
(74) *Attorney, Agent, or Firm*—Young & Thompson

(57) ABSTRACT

A ring-transport type system with load carrying vehicles traveling in one direction, with junctions connecting track on or above ground. The junctions are divided into two types where the first is of an active type for vehicle guiding including a straight track section and an off-line track section curving off the direction of travel. The second type of junction is passive and includes a straight main track section and a curved track section arranged in such a way that vehicles backing through the passive junction under normal conditions follow the straight track section.

15 Claims, 34 Drawing Sheets

TRANSPORT SYSTEM

This patent application concerns a transport system with rail-going vehicles or cabins, where the vehicles are directed by and run on along running rails. The rails are arranged into a track system that forms a continuous ring track, and where the stations for disembarking and embarking always are separate from the main track. This application describes both the track system as a whole, and the rails and vehicles as details in the transport system. In a preferred embodiment of the invention, the tracks are installed on posts, and will therefore not require significant ground real estate. The stations can be designed to be integrated parts of buildings, preferably on higher floors. The transport system as a whole offers advantages of safety, and can be designed to be of little complexity, which offers advantages regarding costs for installation, maintenance and repair.

Introduction

For several years, the applicant has thought about transport systems which could deal with most of the significant communication problems in larger cities, in particular relating to getting around, pollution and noise. There have been performed studies, research and development within this area for more than 30 years, and firms such as Boeing, Ford, General Motors, Honeywell, Matra, MBB, Otis Elevator, Raytheon, and Siemens have been involved in large projects as illustrated by examples in FIG. 1. Research in the area of transportation has been performed at universities in Boston (Harvard and MIT), Minnesota, Seattle, Palo Alto (Stanford) and Gothenburg. Extensive evaluations have been performed for the cities of Gävle, Gothenburg and Stockholm, but all these projects have failed, in large degree because of lack of continuous engagement from public authorities, in spite of the prognosis's predicting profitability even without subsidies. In particular, there was great interest in the USA in the early seventies, but the "Conventional Rail"-industry succeeded through political lobbying to stop the use of public funds on the development of new solutions. A present advantage of this early work is that most of the fundamental concept patents have long expired.

Work has been performed on Automated People Movers (hereafter called APM) since the sixties. Most of the approximately 100 installed systems are in the category Group Rapid Transit (hereafter called GRT), where automated vehicles go in a pre-determined route with a large number of passengers. Mini-GRT also goes in a predetermined route, but only with 4–10 passengers. Personal Rapid Transit (hereafter called PRT) has off-line stations, where the vehicles pass all stations where they have no business. This allows non-stop transport with typically 2–6 people in each vehicle. For the cases of Mini-GRT and PRT, the low weight of vehicles makes it attractive cost-wise to elevate the track from ground level, which release real estate and allow avoiding conflict with ground-based traffic. Simultaneously, it is calculated that the total system cost for the same capacity is dramatically reduced by using PRT with respect to GRT, so that for a given amount significantly better coverage and increased number of stations is possible.

Elevated systems are not in use today, with the exception of some airports and in amusement parks, and only implemented as Mini-GRT. Previously the costs associated with computer systems were prohibitive for realising PRT, and less was known of light metals and composites. But a few years ago, the Chicago transportation authorities assigned Raytheon the task of building a prototype system and large sums of money have been committed. This system, called PRT2000, has already been demonstrated, but the community of practice agrees that it is built so costly and complex that it will not be possible to sell afterwards. But even though it is only designed to transport people, it is always advantageous that someone takes the lead and demonstrates to a sceptical world that someone believes that such a system will be both useful and possible to realise.

The system, according to the invention described in this application, is for simplicity called "Skyway", as in Subway, Highway, Railway, etc. Introducing a new mode of transport, a system according to the invention Skyway, elevated from ground level, will be more affordable than all alternatives. The system according to the invention will be fully automatic, and will be able to transport both people and goods (in automated containers) at low cost and having low energy consumption. Apart from the unusual aesthetics, the system only to a limited degree affects the environment. The vehicles can be both privately and publicly owned, and need not be a public system. Previous projects have not failed exclusively because of failing technology, but also because of faults in concept and business model, as well as a lack of focus on public decision concepts.

The Skyway-system according to the invention is ideally suited for installation in existing city centres as it only requires limited real estate and will give limited disturbance to the existing patterns of traffic during installation, because of a large degree of prefabrication. As an example, related to the building of a completely new part of a city, for example at the geographically central area at Fornebu Airport (closing and released in 1998), a system can according to the invention be installed after erecting the skeletons of buildings. In addition, the system can be easily expanded, allowing expansion according to real needs rather than estimated needs.

By the preferred embodiment of a PRT transport system according to the invention, the stations 8 will in a simple way be integrated in the buildings (FIG. 2), and simultaneously the system will be affordable enough to provide extensive coverage. One can further enhance these synergies by using a PRT system as "horizontal elevators". One can then conveniently go from one building to another in air-conditioned climate. This will integrate buildings over large ground areas. Elevating tracks above ground, using wall fasteners or posts provides increased opportunities for green areas and gives less conflict with other modes of transport. In a vehicle according to the invention there will be seats, but it will also give room to standing passengers, for bicycles, baby strollers and wheelchairs.

Aesthetically, transportation structures above ground represent for many people something new and thereby initially something negative, feelings to be taken quite seriously. During recent years, it has increasingly been acknowledged that the lack of accessibility within some cities has reached intolerable levels, and the costs of underground systems have become prohibitive. Further, there is increased focus on the exhaust gases from combustion engines and noise, and not the least on the consumption of energy from transportation itself. Energy consumption from land-based transport is to a large extent to be attributed to frequent starts and stops, and that the weight of physical safety features is high. A system where the vehicles do not stop between start and destination and thereby is subjected to fewer accelerations, and which also is designed so that the vehicles can not collide with each other, and where the vehicles have lower weight, will in total consume less energy. By electric operation one avoids local pollution and limits noise.

Installation-wise and development-wise, it may be right to design the system to operate in Mini-GRT mode in a simple network initially. Later, one can make the most used stations off-line, which will allow non-stop transport in PRT mode.

Known system concepts, known technology from the field.

U.S. Pat. No. 1,380,732 "Pleasure Railway Structure" describe an amusement park vehicle with railway-type wheels with inner flange. The vehicles drive on two rails on crossties where each rail is put together by a flat rolling surface being higher than the inner flange of the wheel, a covering beam arranged horizontally and standing on its short cross-section side face, with its standing, longer cross-section, side face being taller than the diameter of the wear path/outward contact surface of the wheel, and an upper mounted covering horizontal rail arranged on top of the covering bar and being parallel with the roll path. Thus the rail described in U.S. Pat. No. 1,380,732 does not form an independently carrying structure, but is carried by the underlying crossties. The wheels of the vehicle and corresponding axle is mounted under the bottom floor of the vehicle and the vehicle does not utilise the height of the rails to lower the vehicle down towards the lower part of the rails and loose thereby the possibility to achieve a minimum cross-section profile of rails and vehicle, and thereby a more economic embodiment of the invention and better utilisation of space. This has probably not been a consideration since the purpose was a "Pleasure Railway", in a kind of amusement park.

U.S. Pat. No. 5,282,426 uses the same rail principles as in U.S. Pat. No. 1,380,732, and makes it therefore impossible to drive if the rails are arranged directly on the ground.

U.S. Pat. No. 5,020,446 describe wheels with outer flanges. GB 1 354 638 "Guided Transportation Vehicle" (1974) describe a rail-guided ground based vehicle in a transportation system. The guiding wheel 24, arranged outside of the main wheels 14, force the vehicle to follow the vertical rails on the right and left side of the track. The guiding wheels arranged at the vehicle guiding mechanism 76, which is mounted above and extend outside of the guiding rail, rolls on the outside of the guiding rails 22. Here is similarly the wheels mounted with short axle distance inside wheel compartments in the vehicle, and not as a wide track configuration, where the wheels are running on rails on each side of the vehicle according to the preferred embodiment of the invention.

GB 1 511 910 "Improvements in or relating to vehicular transportation systems" describes a guiding arrangement on vehicles. The guiding rail is arranged on the branching junctions along the track. The guiding arrangement is designed for pre-positioning and thereby latch onto the pre-selected right or left guiding rail as the vehicle reaches a junction where the vehicle has to choose one of two directions, right or left.

Known PRT systems are either based on the vehicles moving on rails on ground, or the vehicles moving on top of, on the side of, or under elevated track beams (FIG. 1). Common to all PRT systems is the need for a "switching-system" (junction guiding arrangement) which allow the tracks to split into two tracks, and for two tracks to join into one. Without this functionality the realisation of a network as shown in FIG. 3 with off-line stations be impossible. The elevated systems are to some degree derived from the metaphor of the "Monorail", which is based on an along running support beam with tracks. An advantage with only one along running support beam is that it only to a limited degree appear visually intrusive, but the disadvantageous are numerous:

Standing on Tracks

The vehicle is balancing on top of a track beam, and requires many mechanisms to ensure it will not fall down. Raytheon's system has first a large-diameter along running steel tube underneath, and then the tracks on top, on which the motorized under-carriage of the vehicle roll, with the passenger carriage on top. Even though only sitting passengers are permitted and only 1.5 m interior height, the whole structure measures approximately 3.5 m from bottom to top. Further, on-top systems are susceptible to snow and icing, and one risks colliding with people or animals on the tracks.

Hanging on the Side of Track Beams

The core idea of this arrangement is to permit vehicles to go on both sides of the same beam, thus limiting visual impact of the beam. However, torsion considerations require that support poles and track beams will have to be particularly rigid, and thereby expensive. But most seriously, the junction switch becomes quite complex and causes systems with active junctions to become quite expensive to build.

Ranging Under Beams

A vehicle hanging under a track beam is more exposed to possible damage from other vehicles travelling beneath it, and additionally, junctions will be more complex because the main suspension arrangement bars during for example a left turn in a junction will have to pass "trough" the rails of the track going to the right. In strong winds, the vehicle will be exposed to great forces that can cause a pendulum type movement.

The purpose according to this invention is to maintain the advantages of the above described system concepts based on known technology from rail-going transport systems, preferably based on posts supporting track beams with rails, but simultaneously to avoid many of the disadvantages with known technologies for support and guidance of the vehicles.

SUMMARY OF THE INVENTION

The invention comprises a type system with ring-type transport for one transport direction, with track junctions connecting tracks on or above ground, consisting of pair-wise parallel running rails with fixed track width, with load-carrying vehicles with wheels, where the track above ground includes along running beams with an open track with height larger than the diameter of the wheels along the inner surfaces of the carrying beams, with rails arranged on a lower surface of the track, where the beams can be arranged on carrying posts or fixed to walls, and where the rails on flat ground is arranged on the ground.

The new and characteristic of the invention is:

active or controllable track junctions "Y" comprising of a preferably straight main track section "Y"R and a deviation track section "Y"B to one of the sides of the direction of travel, either only to the right, or only to the left of the main track section "Y"R passive collecting track junctions "λ" (in the direction of travel) comprising of a straight track section "λ"R and a curved track section "λ"B, arranged in such a way that vehicles when backing through a passive "λ-junction" under normal operations only follows the straight track section "λ"R.

Other characteristics of this invention are according to the dependent claim, and according to the following Figure description and the detailed description of the system components.

FIGURE DESCRIPTION

The invention will in the following be described with reference to the accompanying figures with reference numerals.

Figures 4A, 4B:
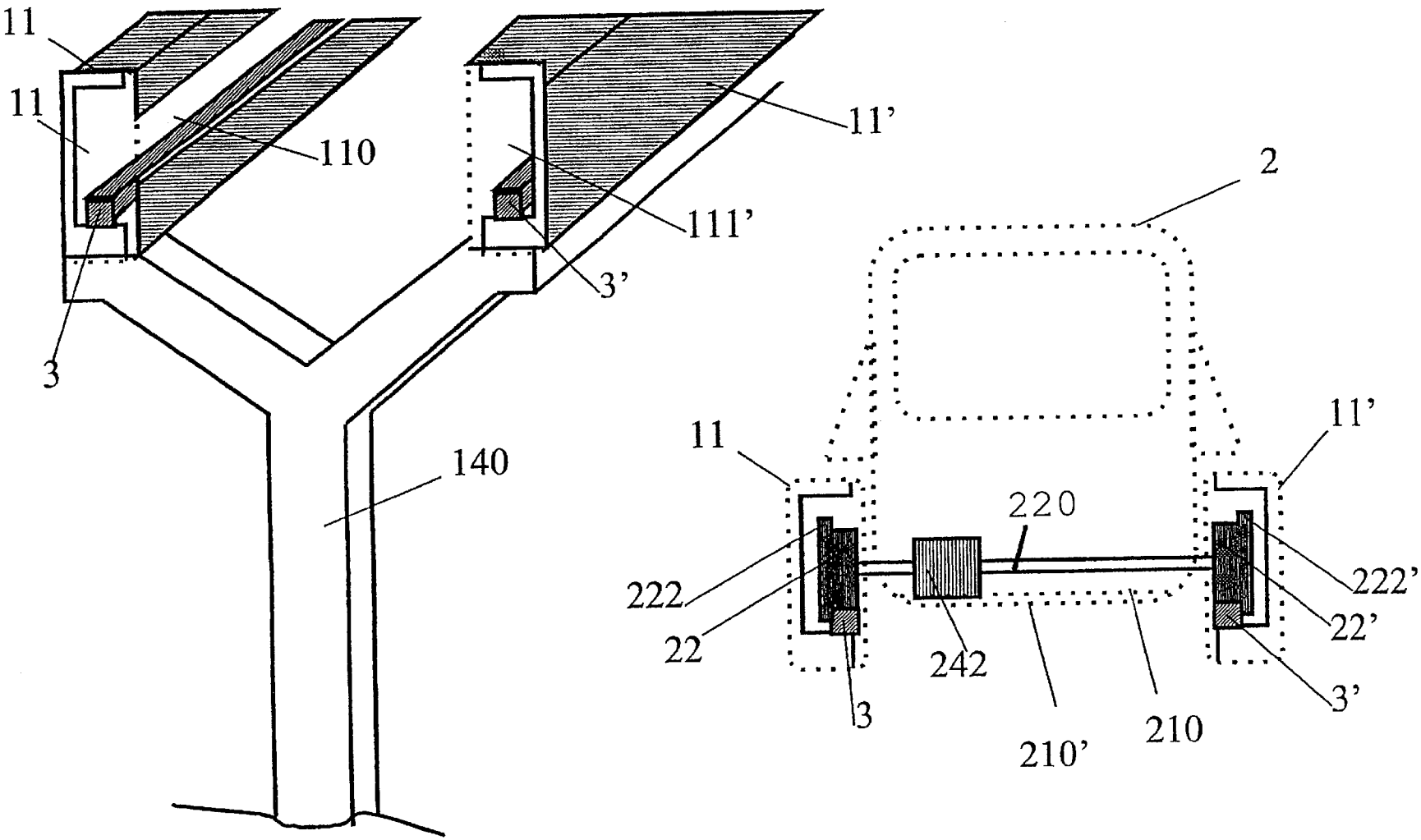

FIG. 4*a* is principle-schematics of a track for the transport system according to the invention, with an Y-shaped post supporting the two parallel along running beams with the rails.

FIG. 4*b* describes a cross-section of a vehicle with built-in engine.

Figure 4C:
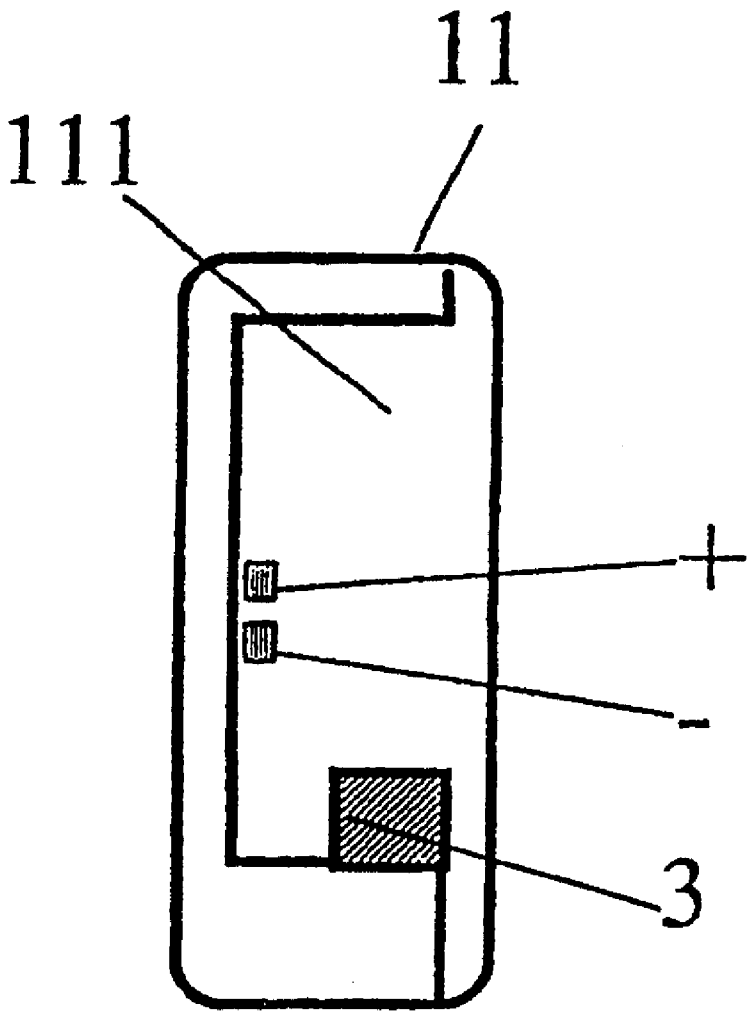

FIG. 4C shows a cross section of a carrying beam.

Figure 5:
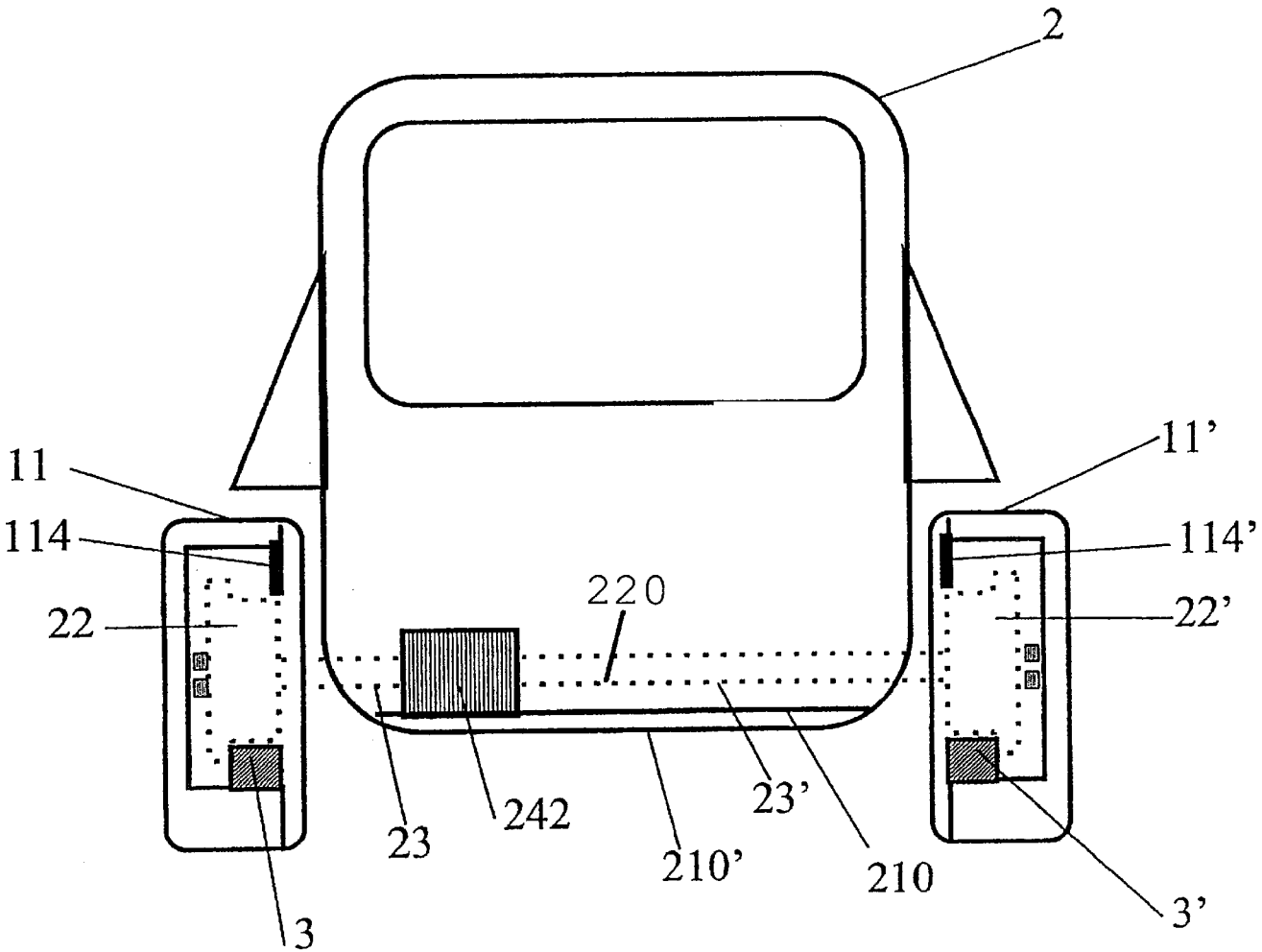

FIG. 5 describes a section of a vehicle with wheels shown on the rails, where the vehicle is shown from behind.

Figure 6:
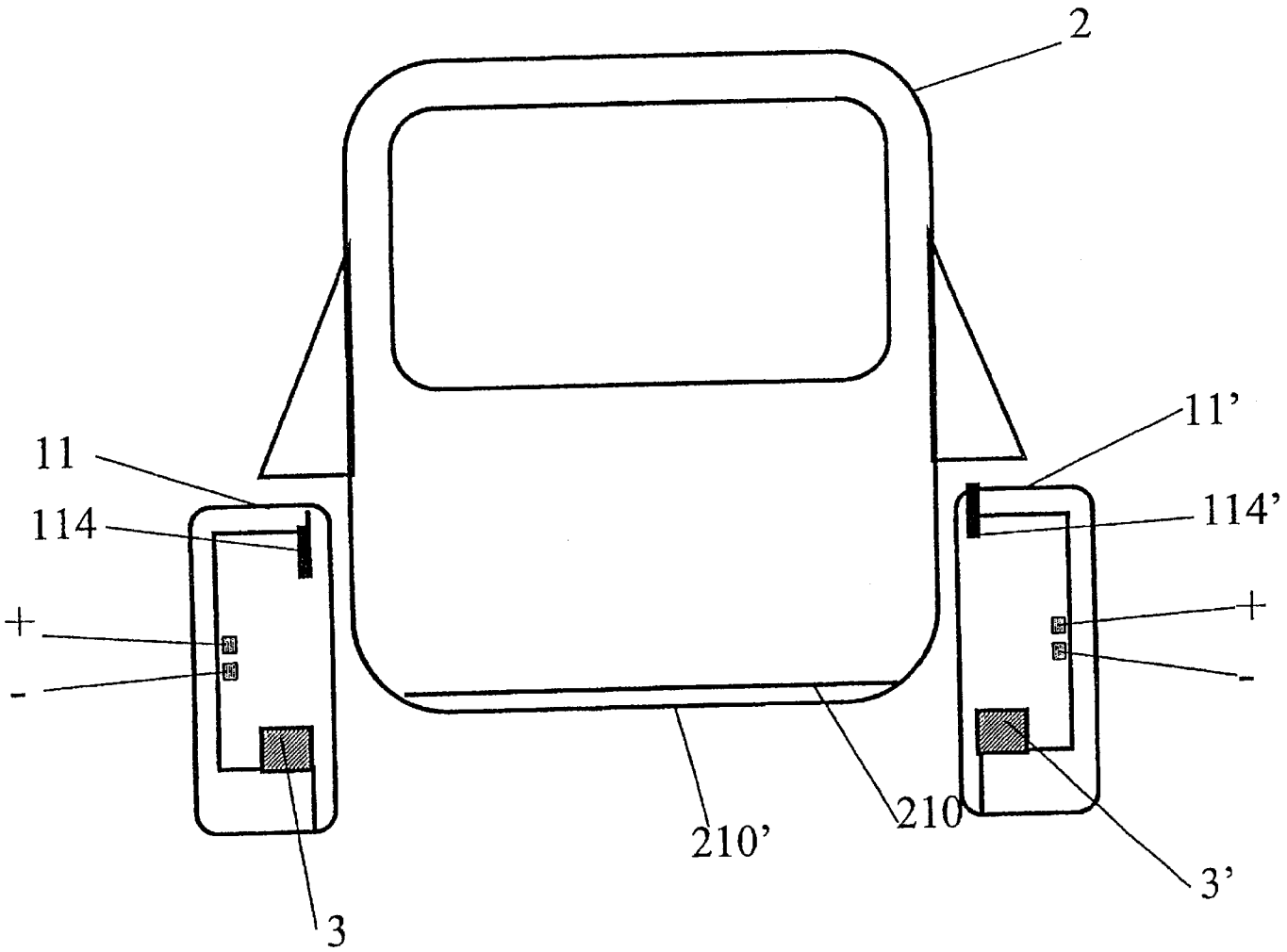

FIG. 6 shows what is defined as the wheel cavity in is respectively the right and left along running beams with rails.

Figure 7:
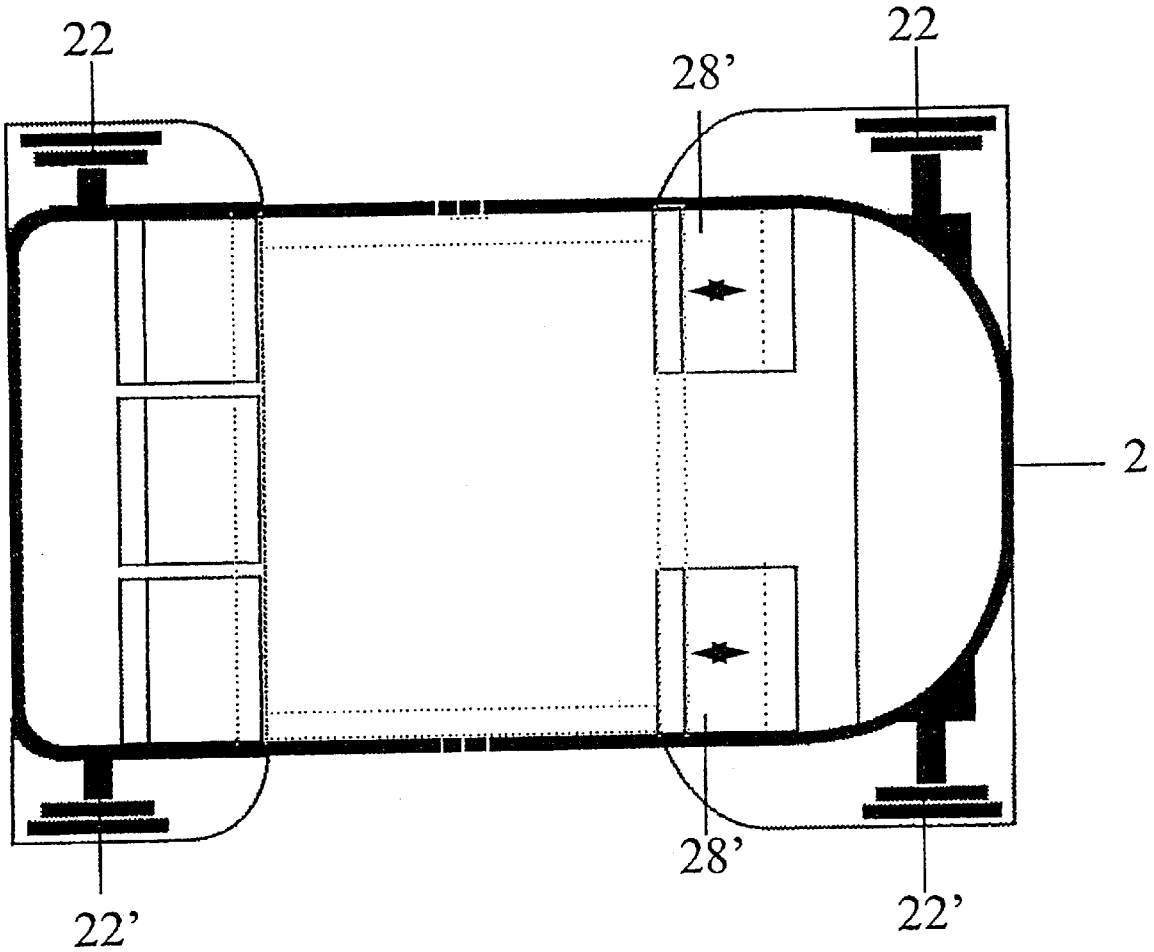

FIG. 7 is in plane section a principle-sketch of a vehicle between two along running beams.

Figure 8:
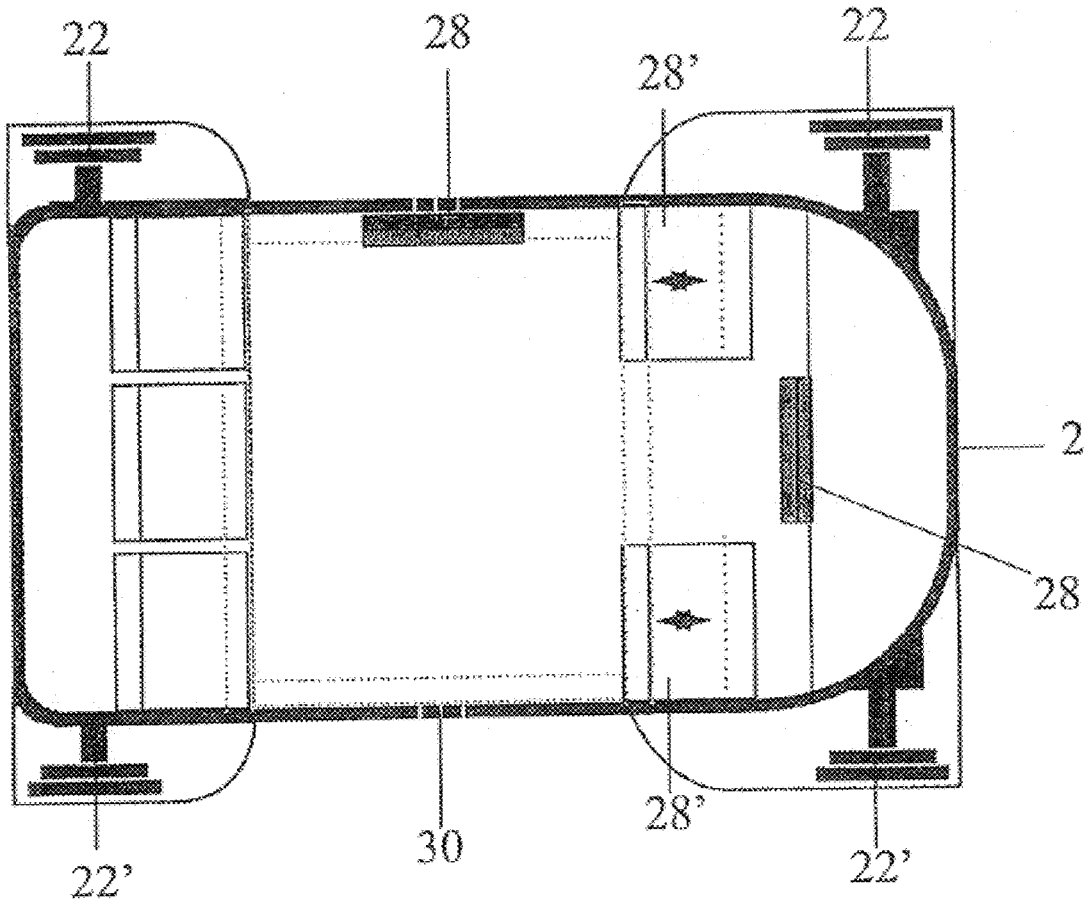

FIG. 8 sketches a possible arrangement in the vehicle.

Figure 9:
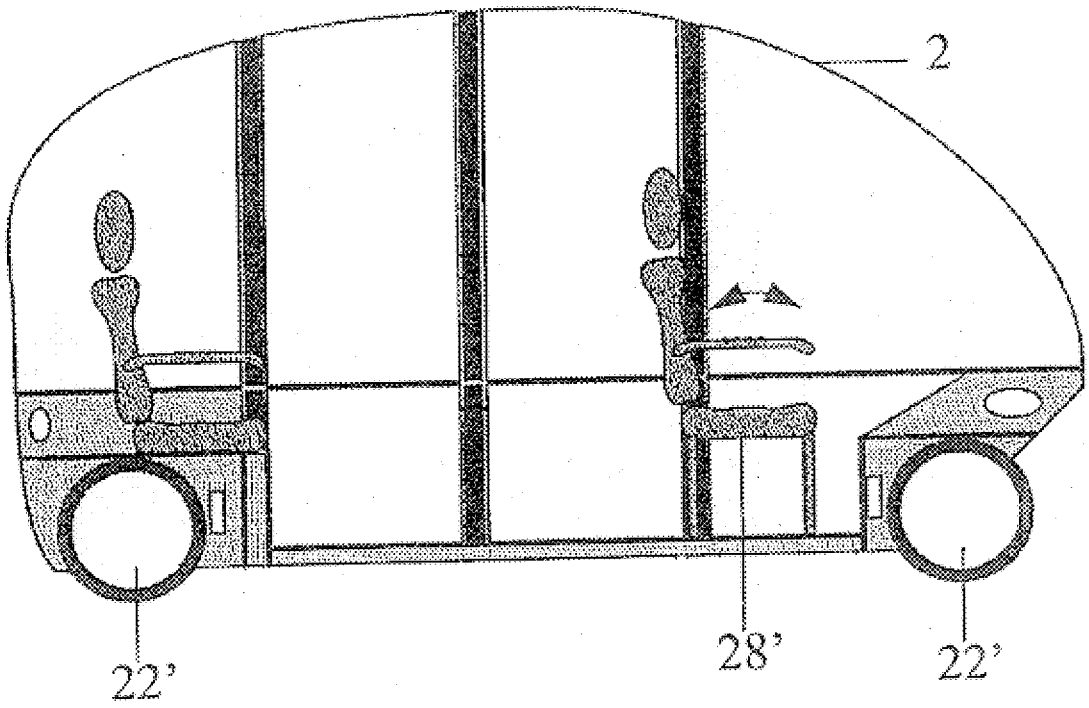

FIG. 9 sketches in side elevation view and partial section a vehicle and a beam, seen from the side.

Figure 10:
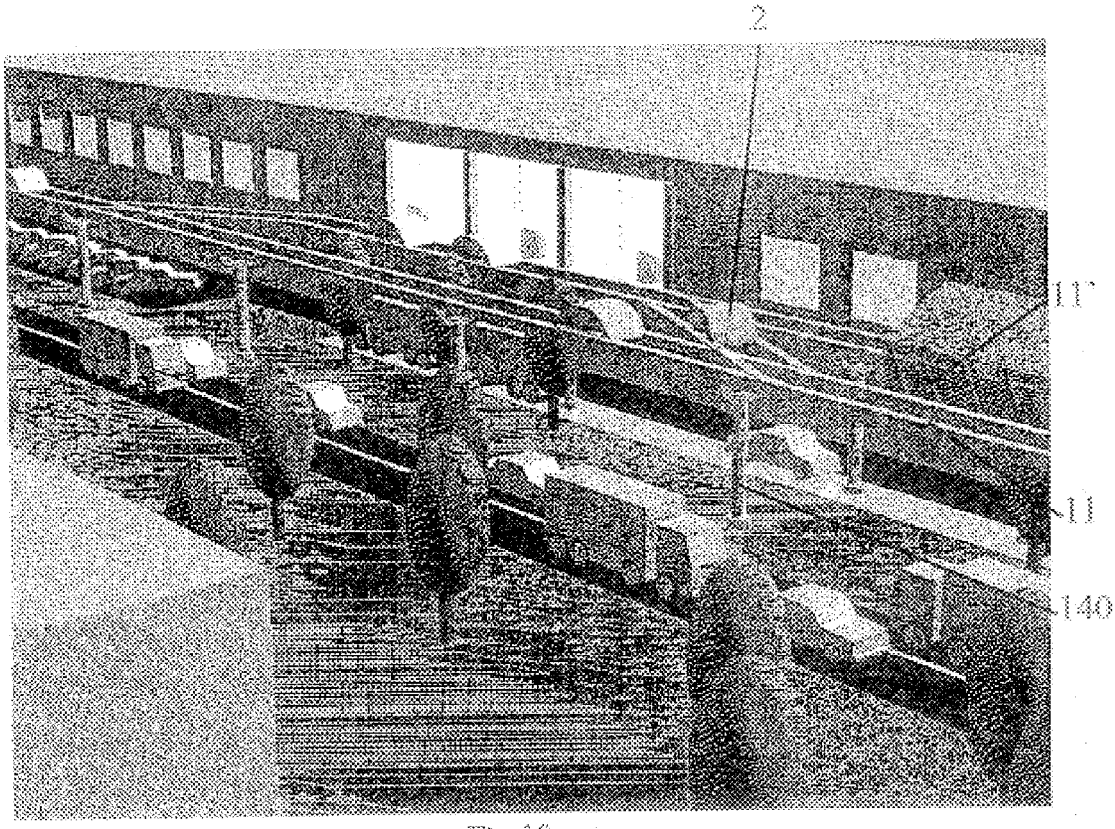

FIG. 10 shows in perspective view a simple sketch of a track according to the invention, in addition to a track section.

Figure 11:
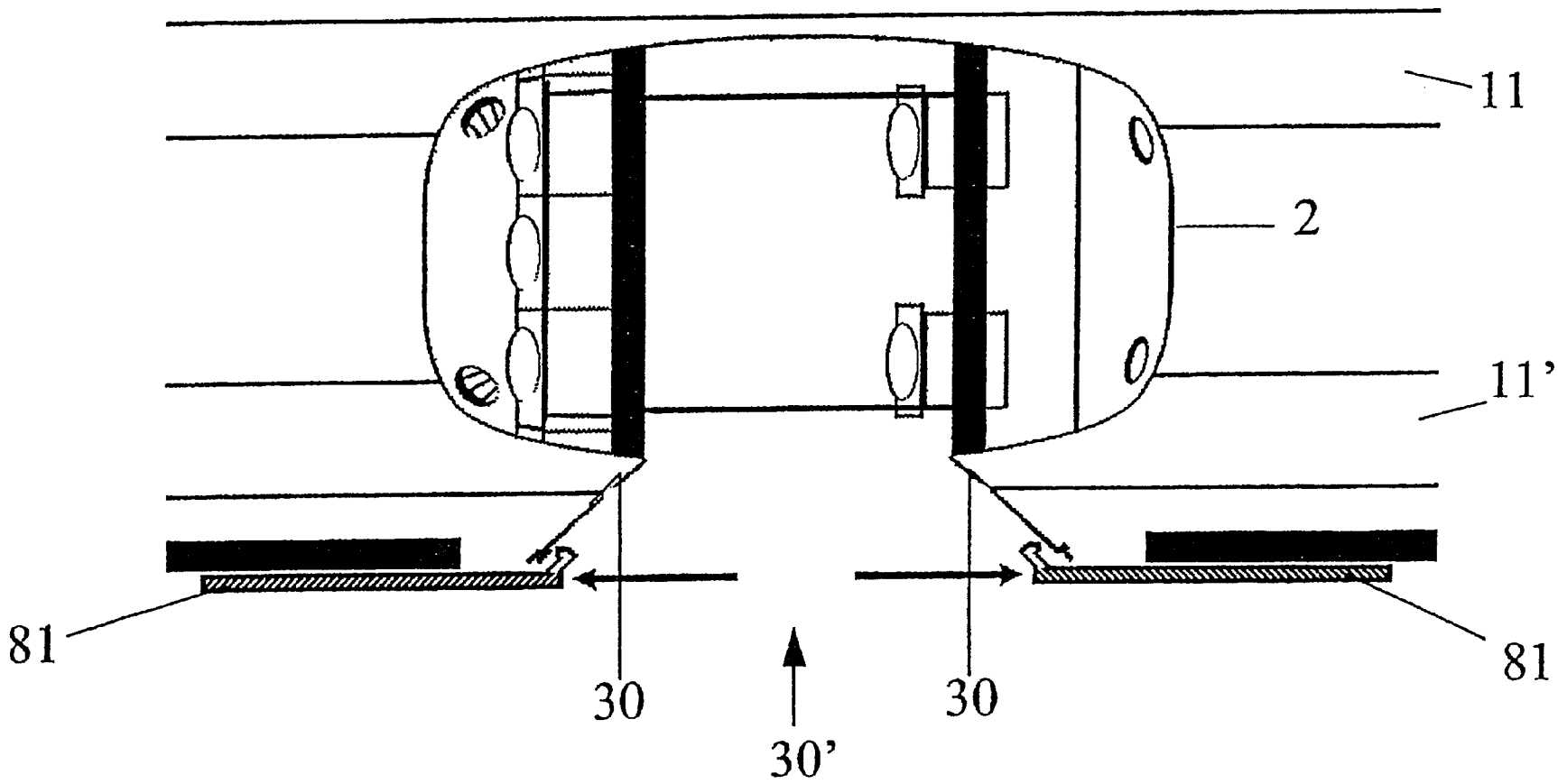

FIG. 11 sketches a possible arrangement for opening the vehicle doors, according to the invention.

Figure 12:
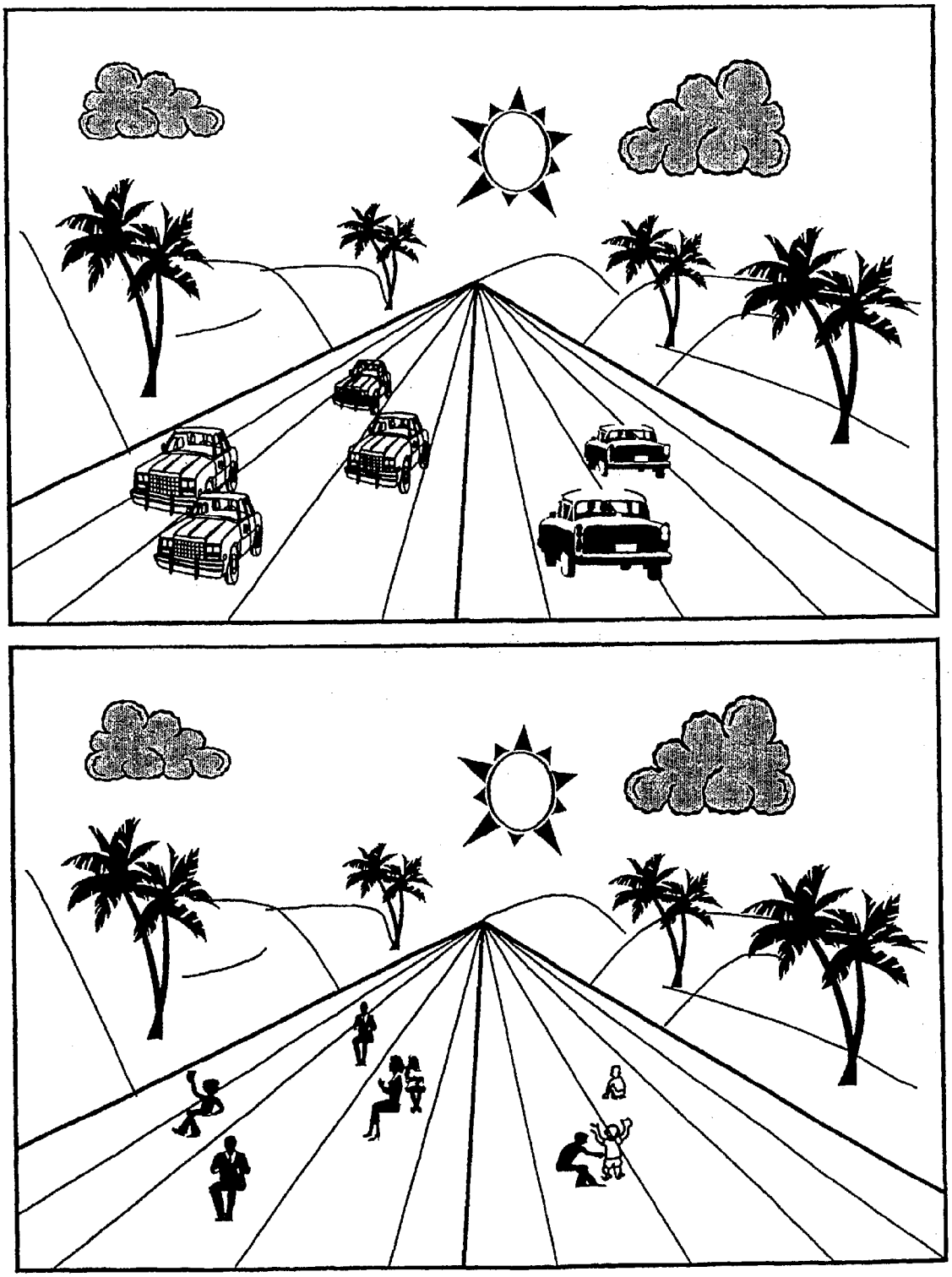

FIG. 12 shows on top a photography of cars on a highway. Below is shown an illustration of the transported people, which these cars really contain.

Figure 13:
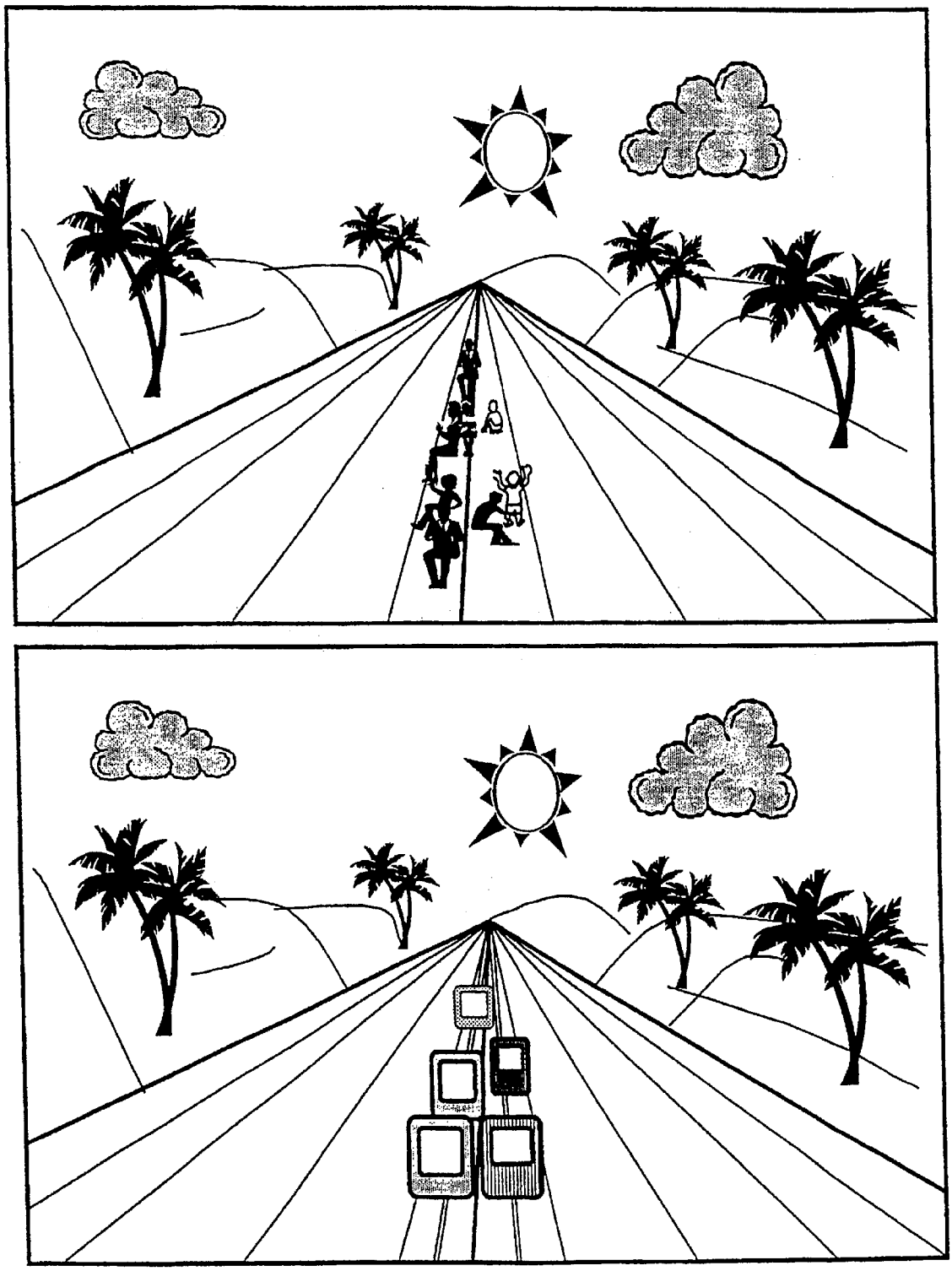

FIG. 13 shows on top the same transported people as in FIG. 12, assembled to the sides in the middle of the highway, and illustrates the capacity of the highway. Below is shown the vehicles, which according to the invention would be required in a transport system according to the invention.

Figure 14:
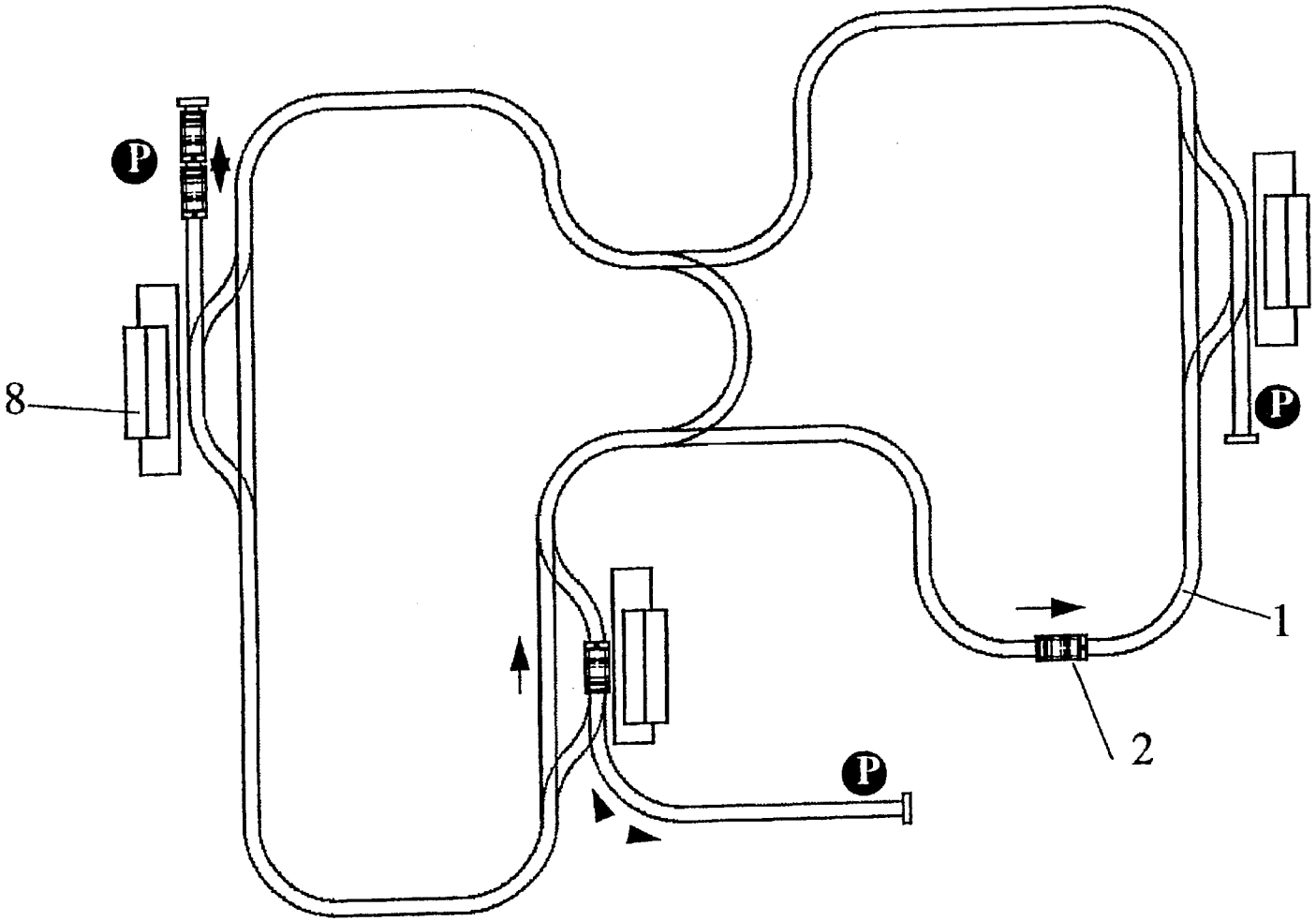

FIG. 14 sketches a transport system according to the invention, comprising of a simple network with junctions.

Figure 15:
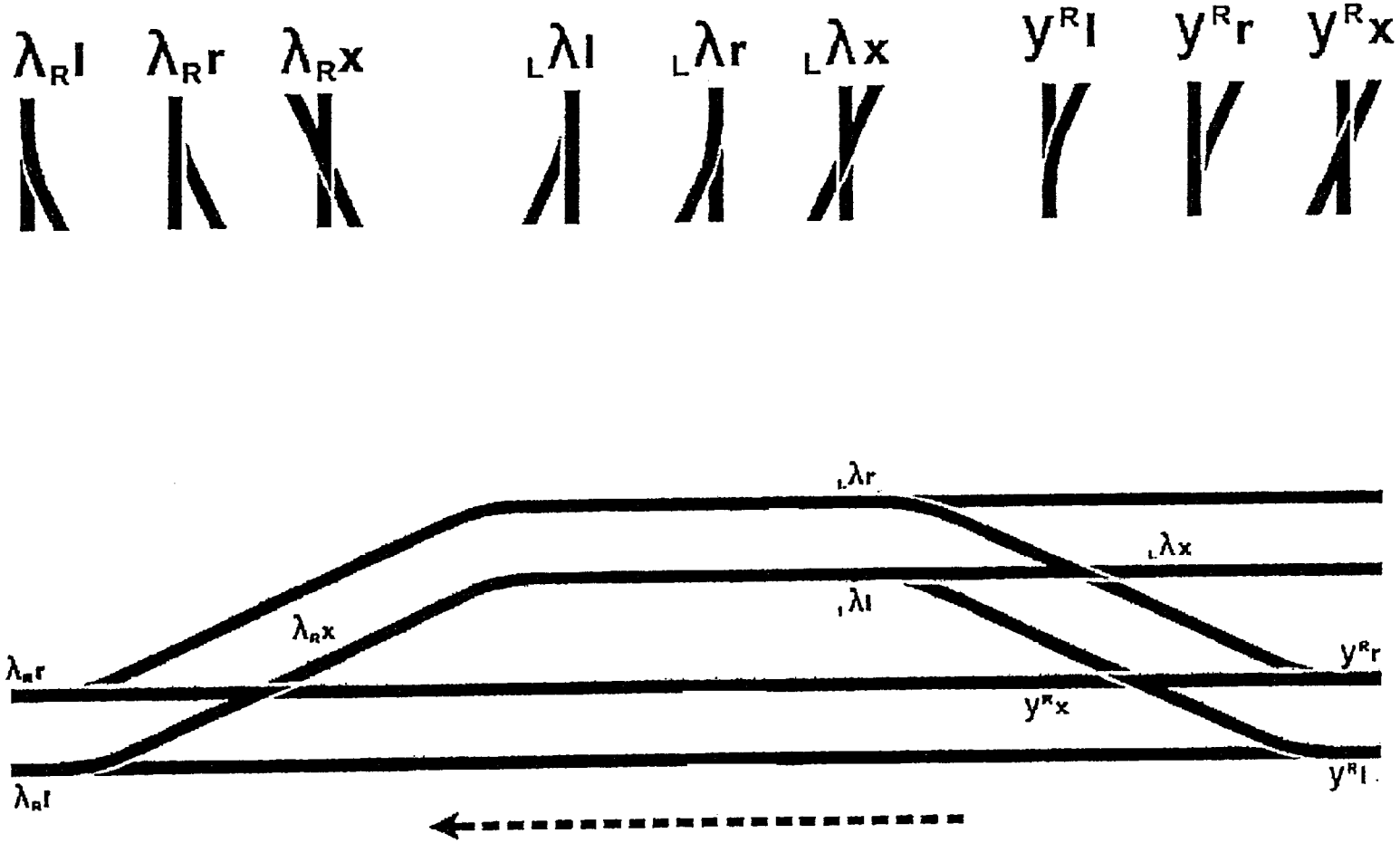

FIG. 15 shows a principle-sketch of the different rail sections according to the invention.

Figure 16:
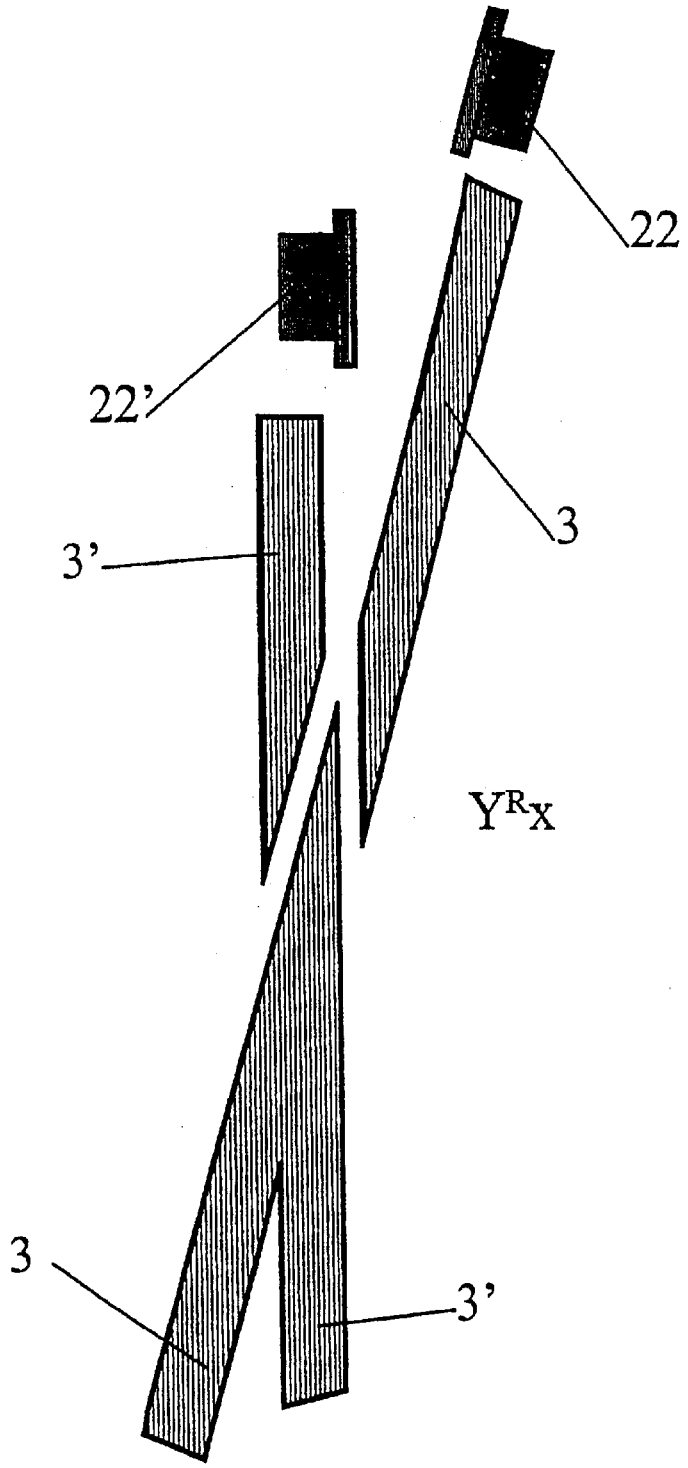

FIG. 16 is a principal-sketch of a passive rail section Ax.

Figure 17:
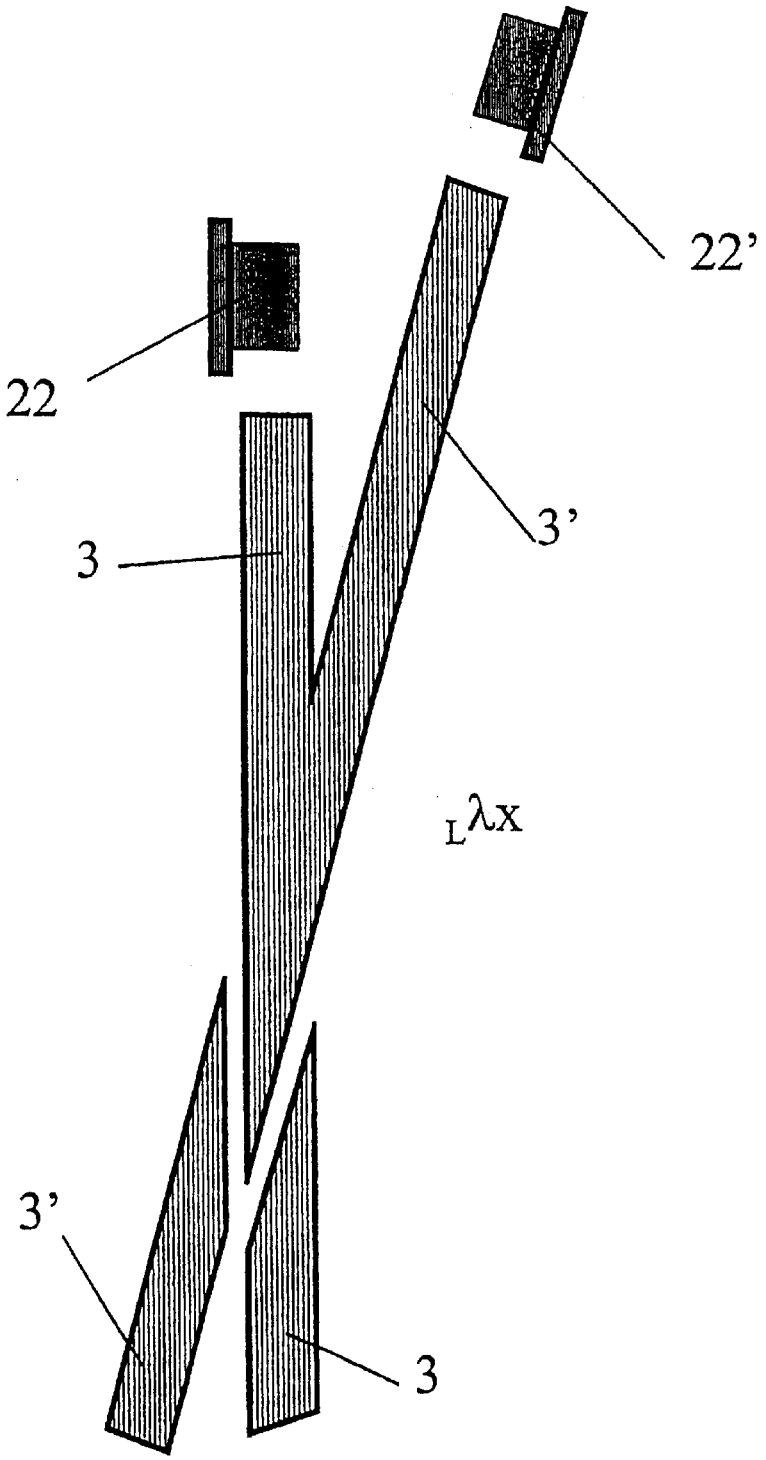

FIG. 17 is a principal-sketch of a passive rail section Bx.

Figure 18:
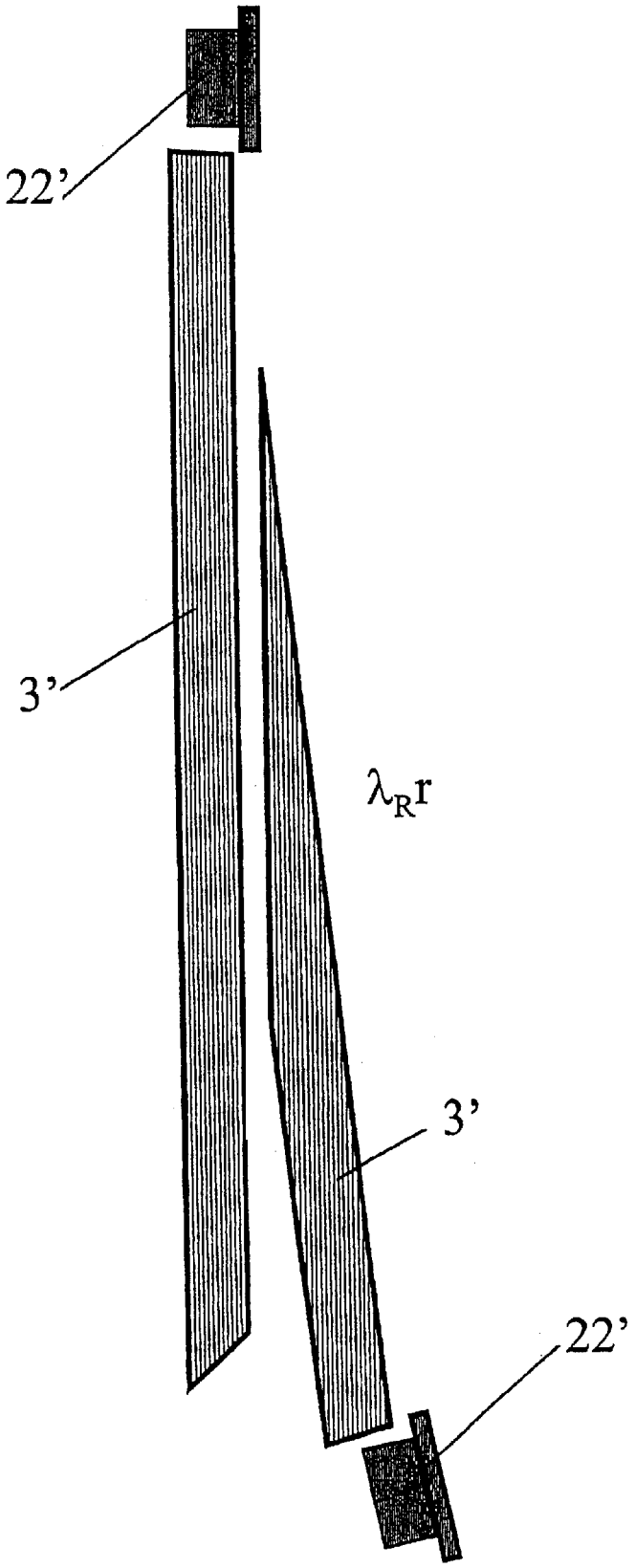

FIG. 18 is a principal-sketch of a passive rail section B1H.

Figure 19:
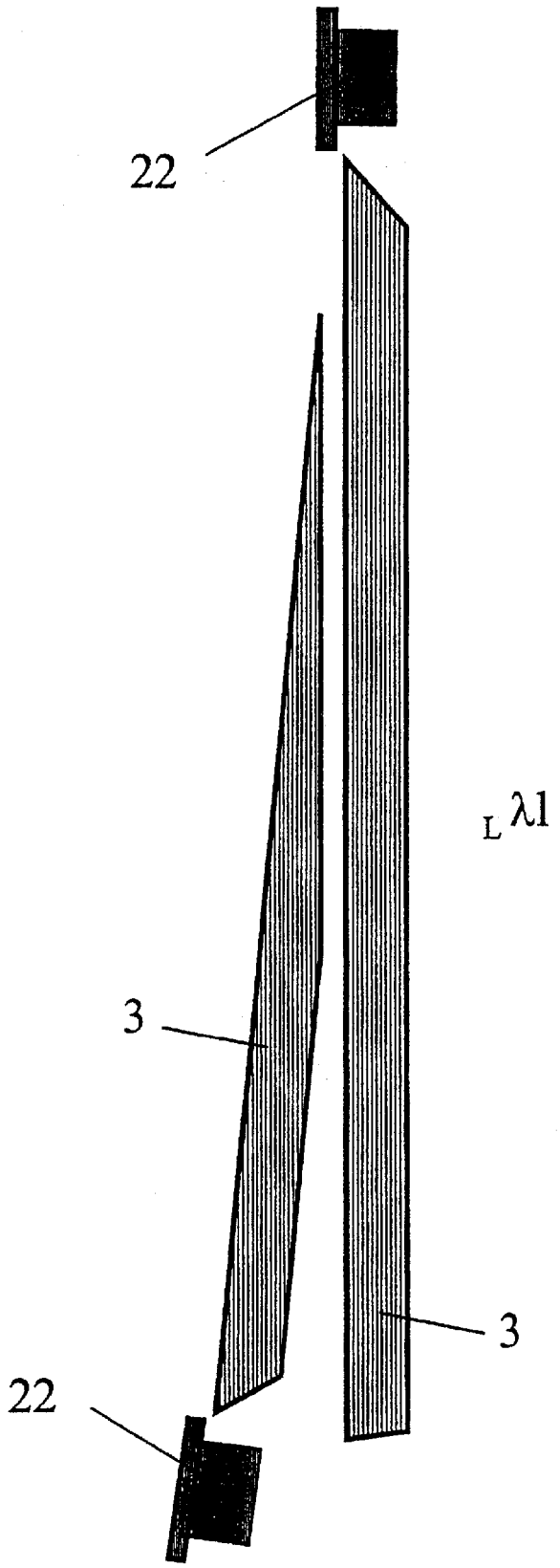

FIG. 19 is a principal-sketch of a passive rail section B1V.

Figure 20:
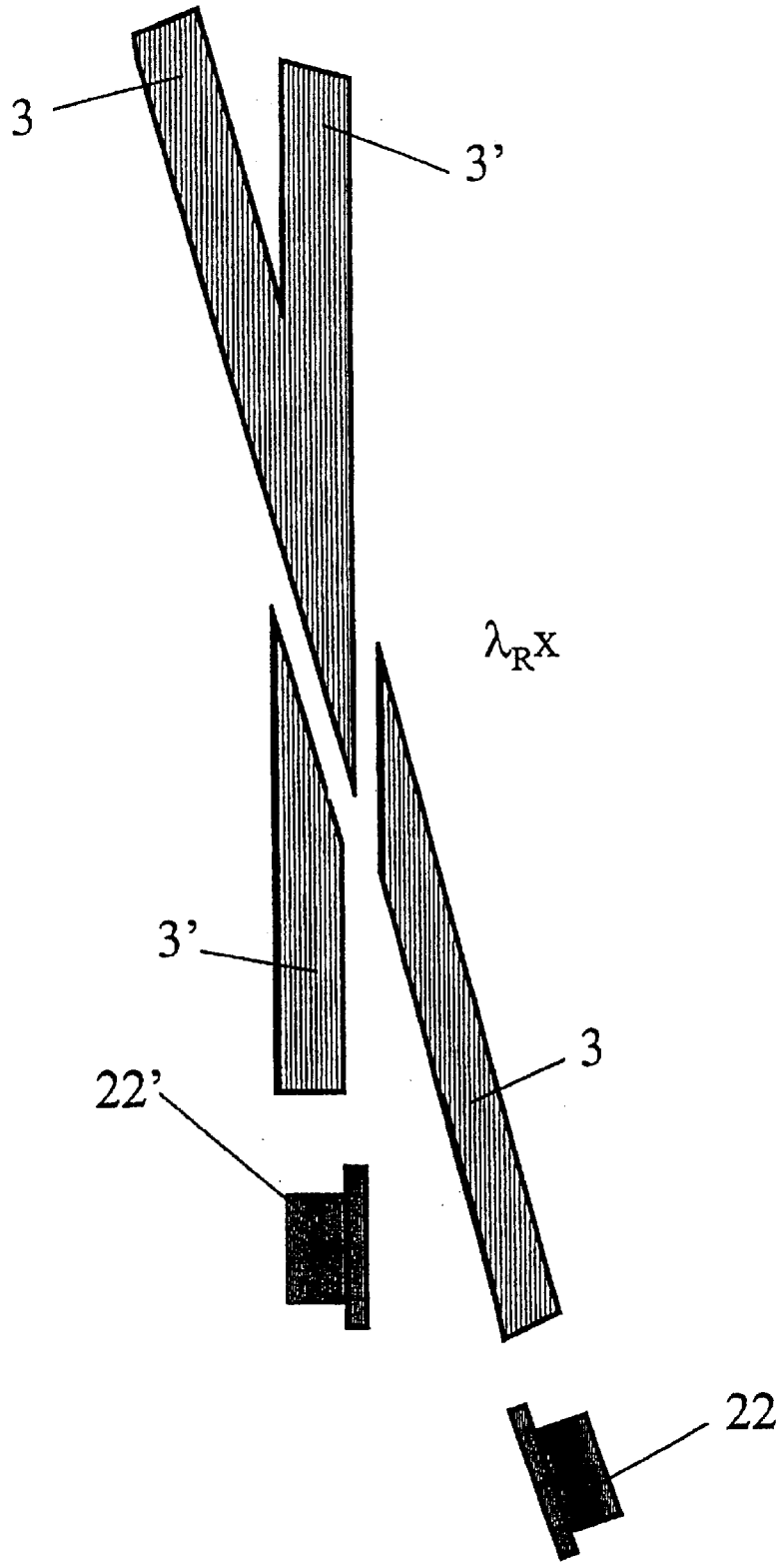

FIG. 20 is a principal-sketch of a passive rail section Cx.

Figure 21:
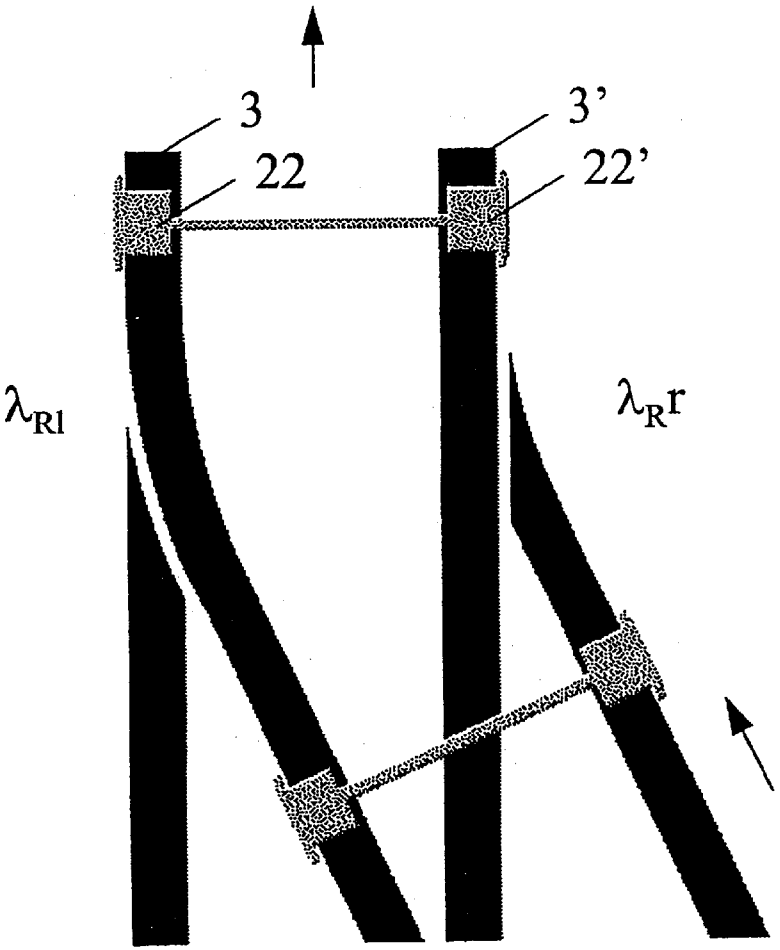

FIG. 21 is a principal-sketch of passive rail C1V and C1H.

Figure 22:
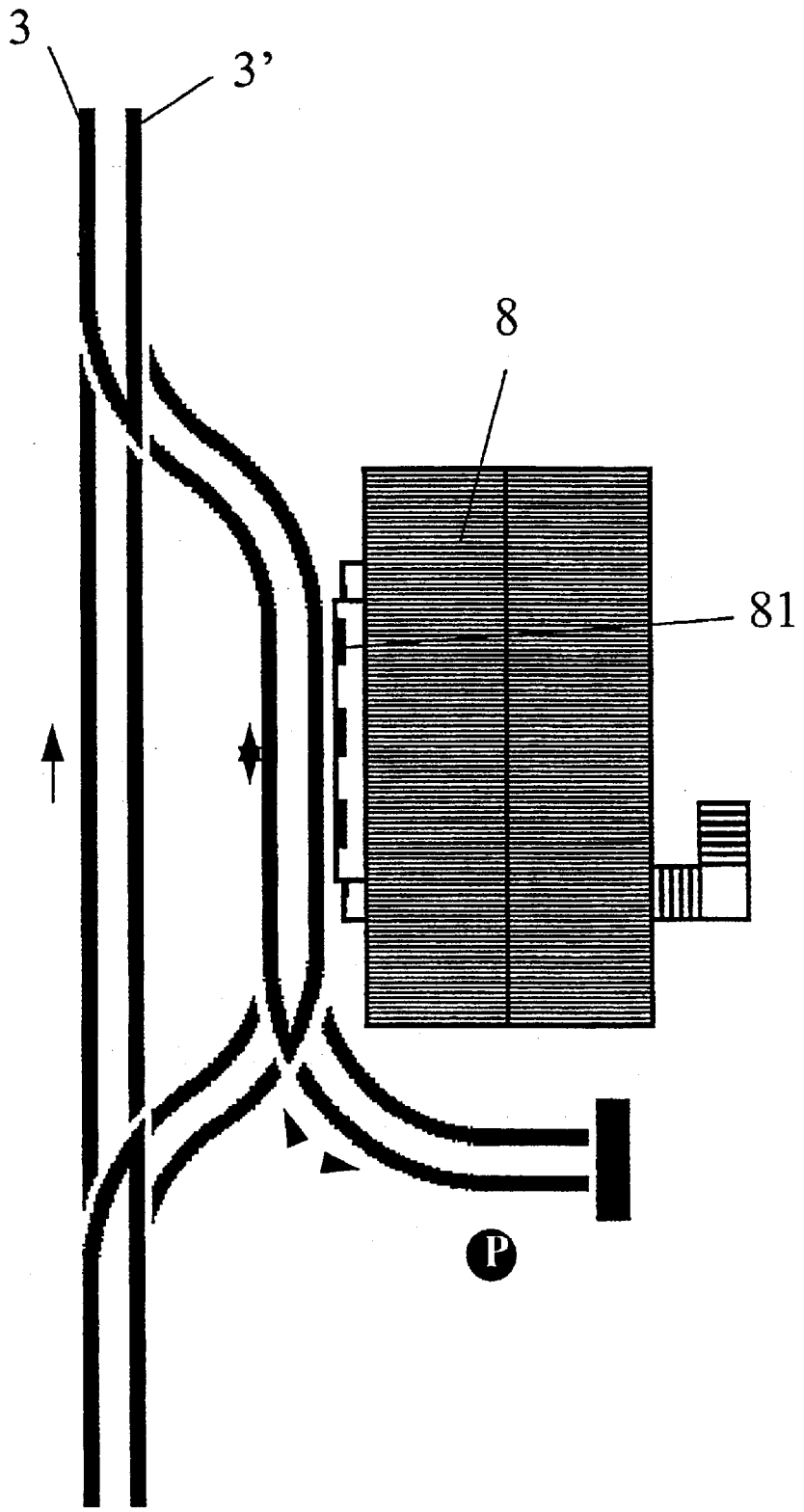

FIG. 22 shows a preferred embodiment of the main track, off-line tracks, parking tracks and station, according to the invention.

Figure 23:
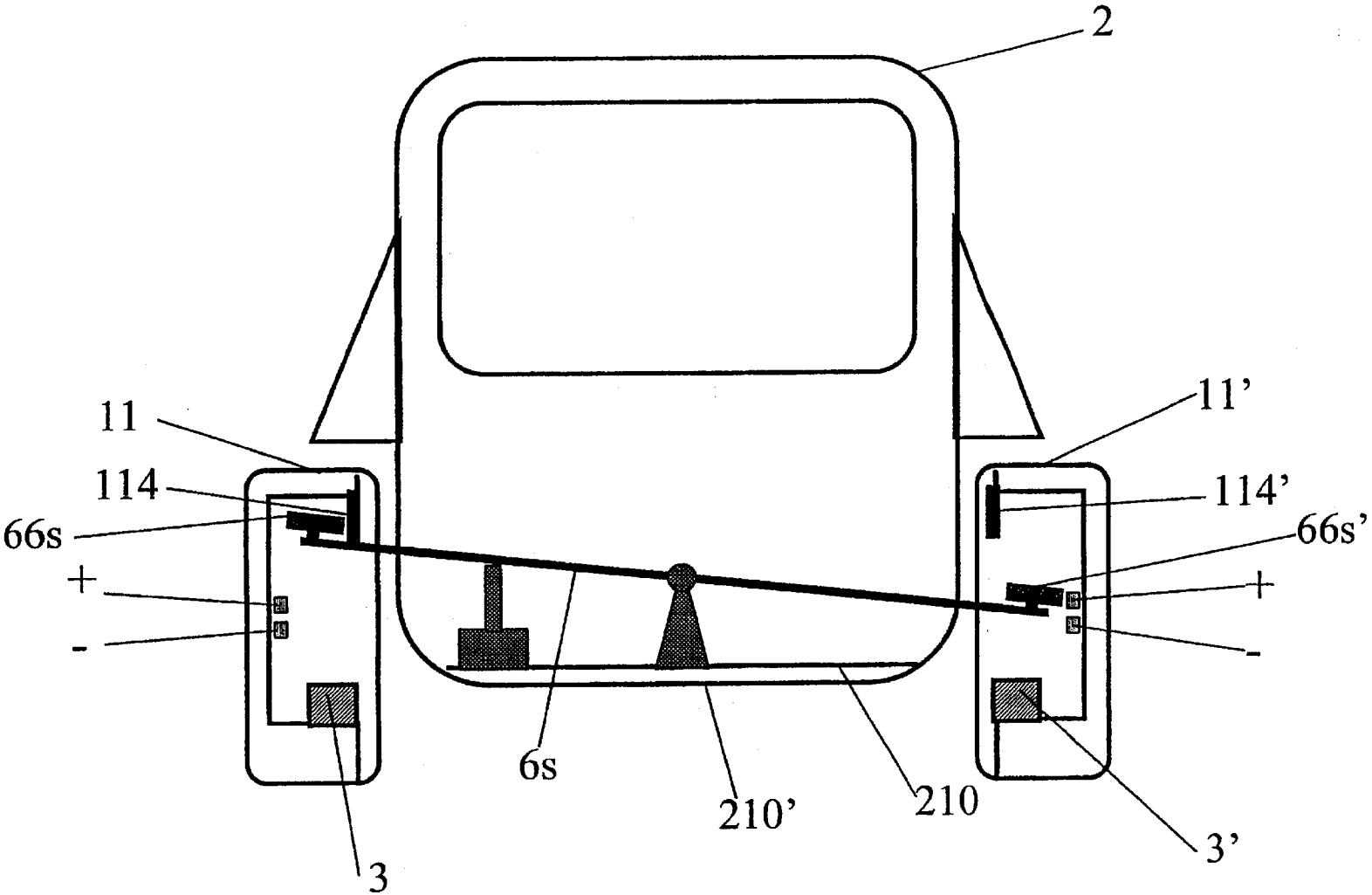

FIG. 23 is a section view of a vehicle and shows the mechanical parts, particularly a vehicle guiding mechanism, which according to the invention is used for active guiding in the vehicle.

Figure 24:
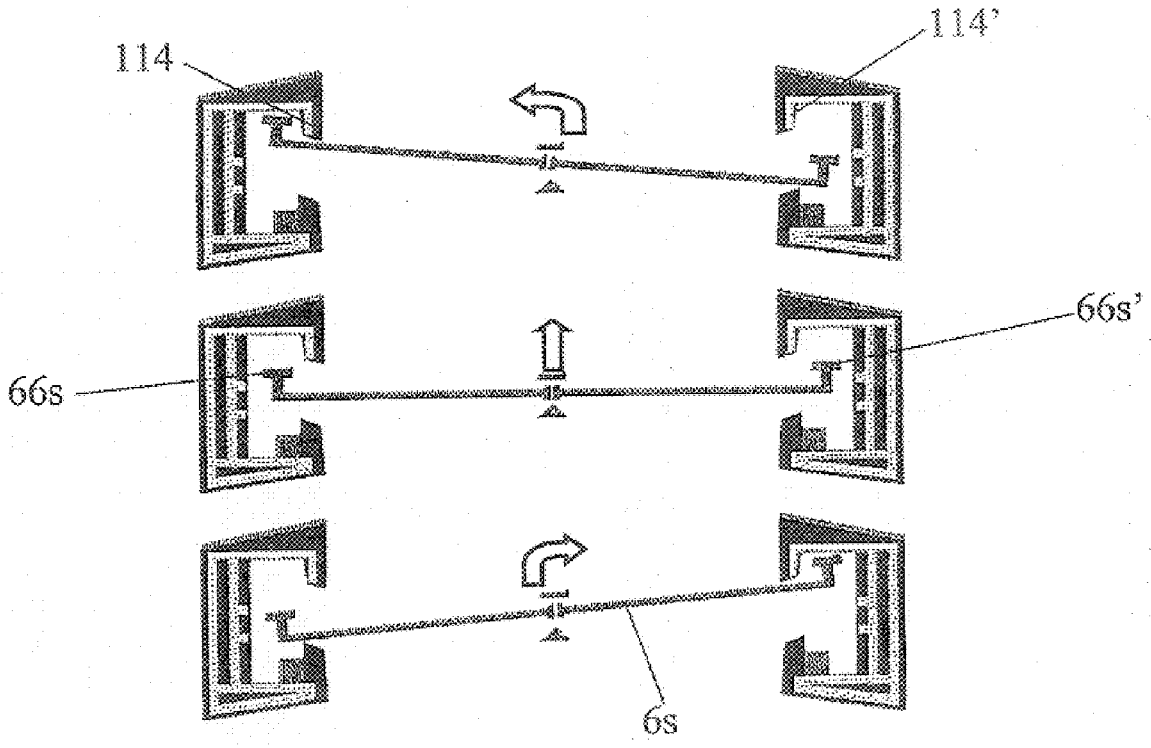

FIG. 24 sketches in vertical section elevation view, the positions of the vehicle guiding mechanism from FIG. 23 in interaction with the guiding rails arranged parallel to the right or left rails.

Figure 25:
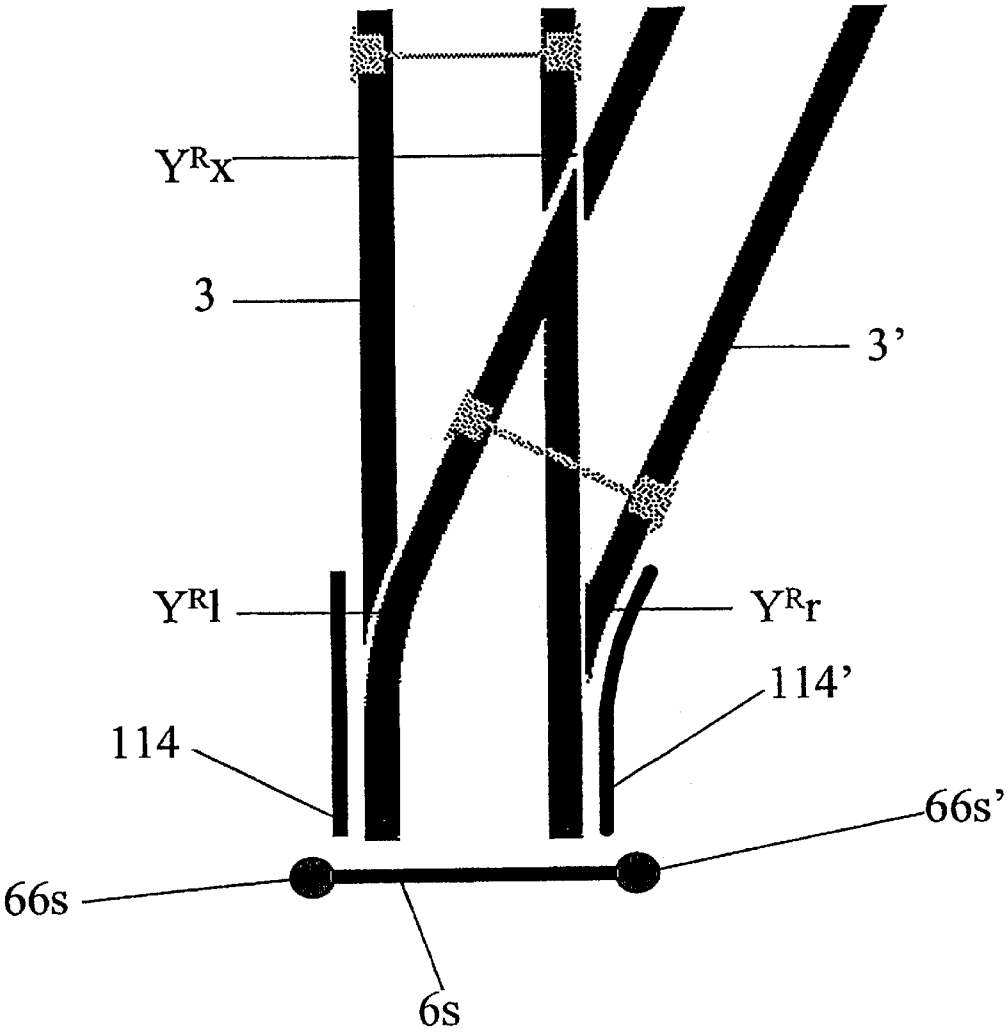
Figure 26:
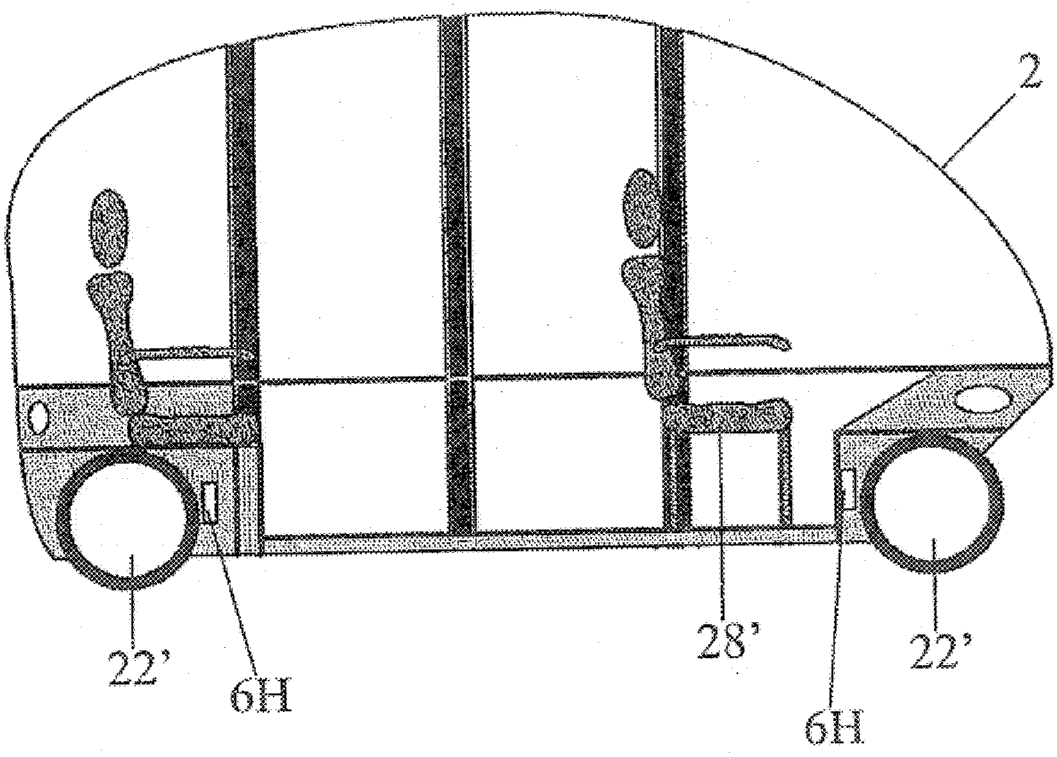

FIG. 25 shows in plane view the arrangements with guiding rails in AY junction FIG. 26 shows in side elevation view and partial section, holes or slits for vehicle guiding mechanisms arranged in the wheel compartments.

Figure 27:
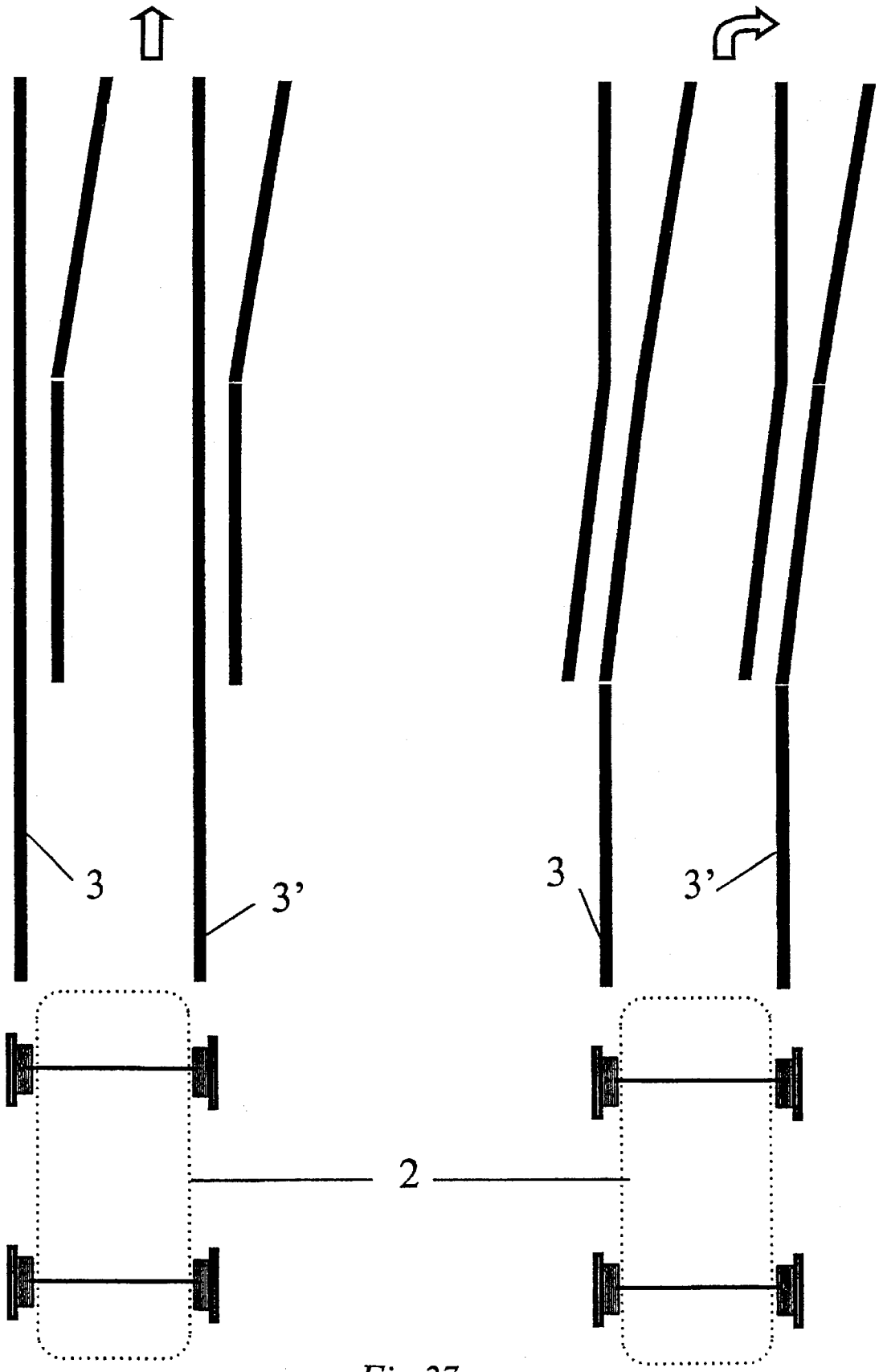

FIG. 27 sketches in plane view a possible embodiment in the form of a hinged junction mechanism.

Figure 28:
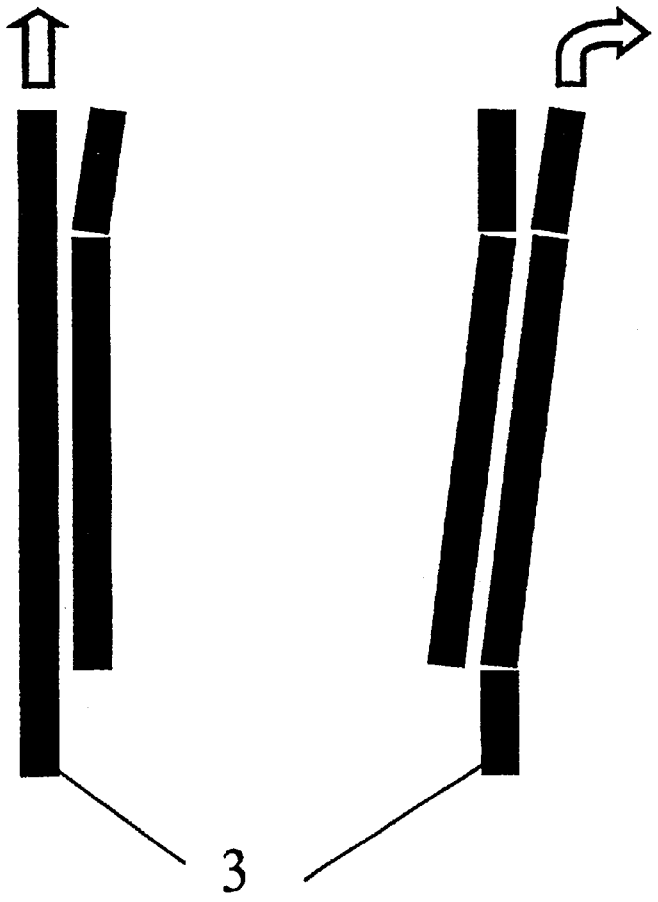

FIG. 28 sketches a detail of a possible embodiment of the invention, Y junction with active and hinged rails as shown in FIG. 27, in the two positions.

Figure 29:
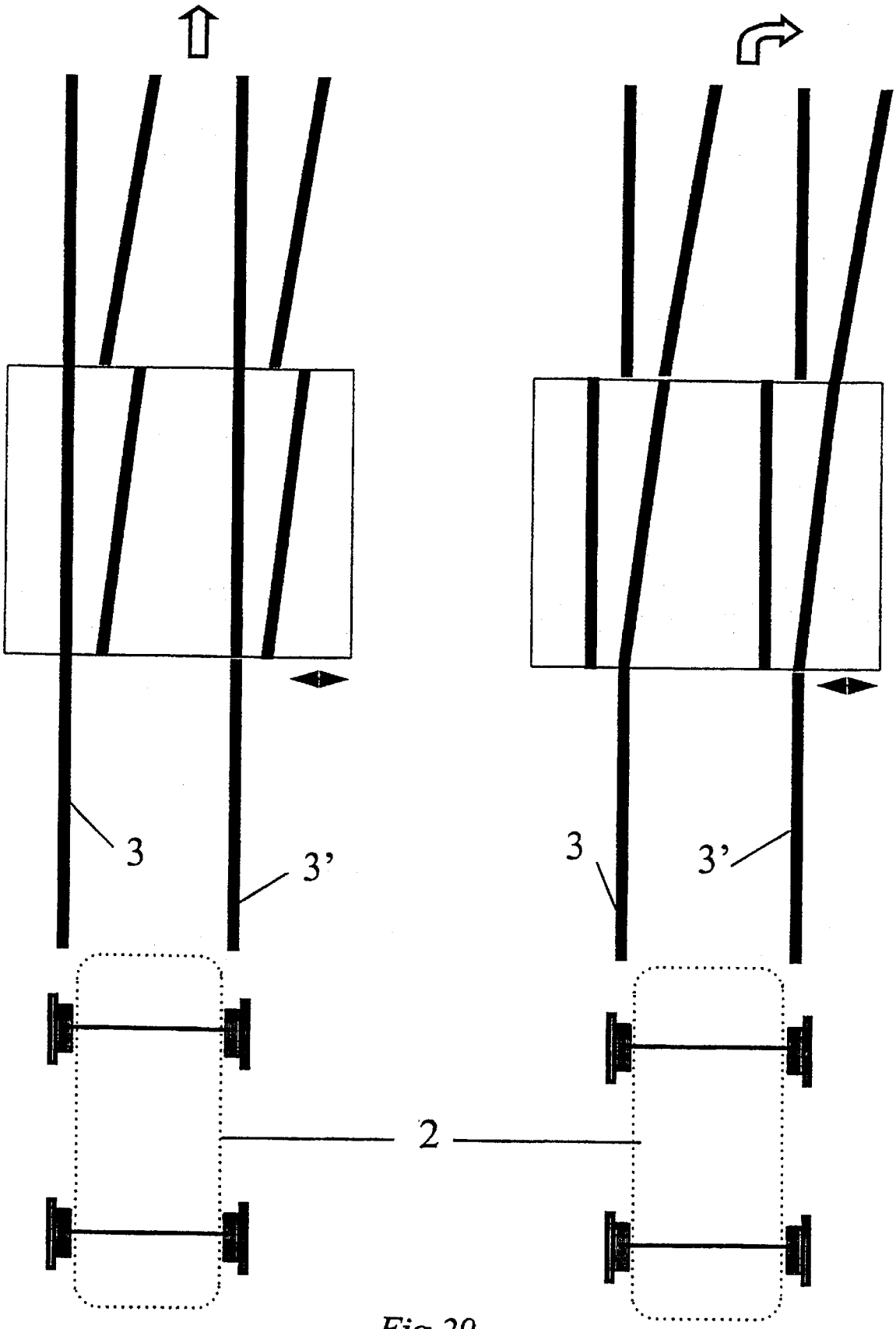

FIG. 29 is a plane view of a possible, non-preferred embodiment of the invention in the form of a hinged partial junction, in two positions.

Figure 30:
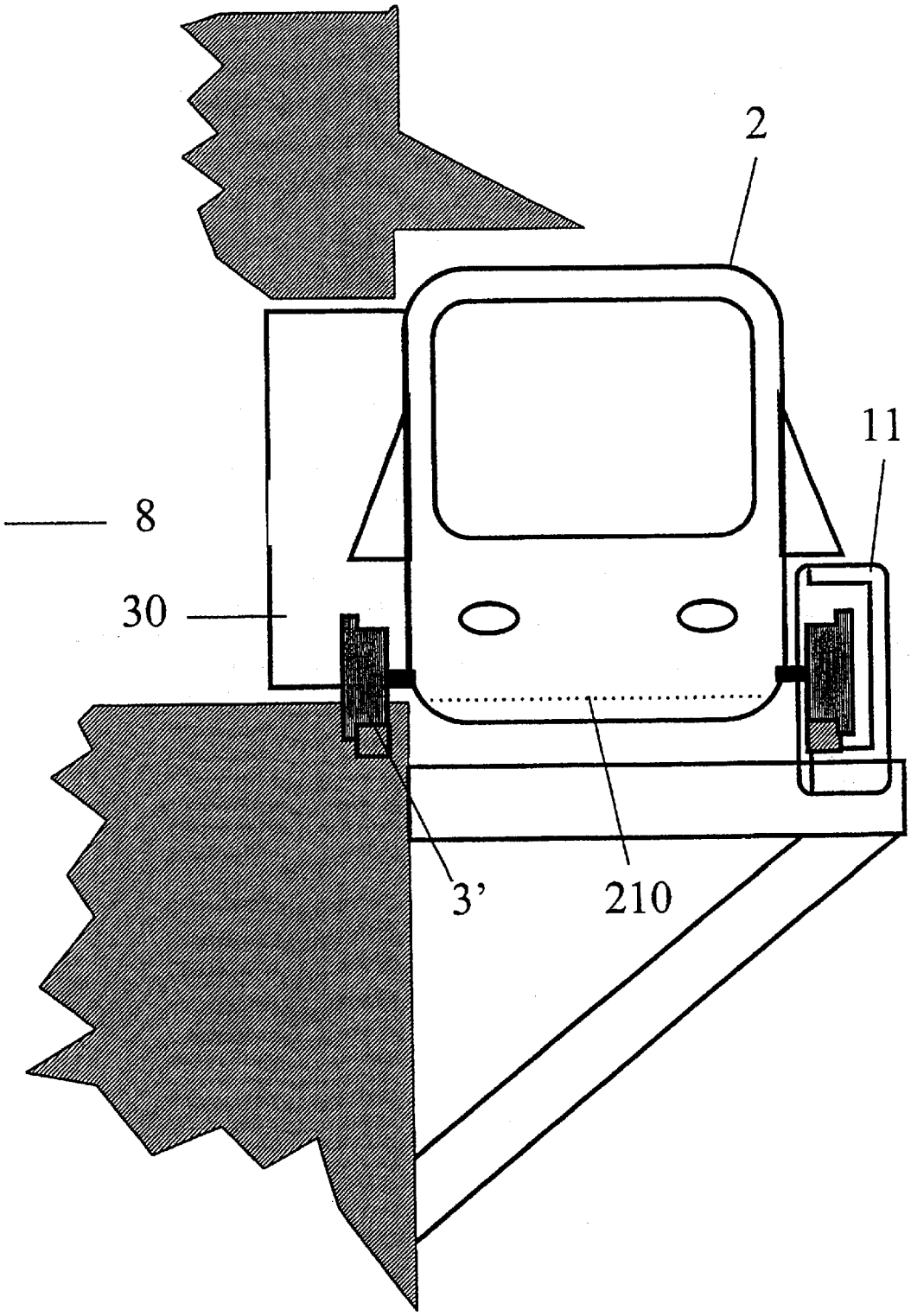

FIG. 30 shows a section of an arrangement according to the invention with a vehicle at a station gate. The station can be part of a floor in a building, for example next to an outer wall, but also in a tunnel going partly or fully through the building.

Figure 31:
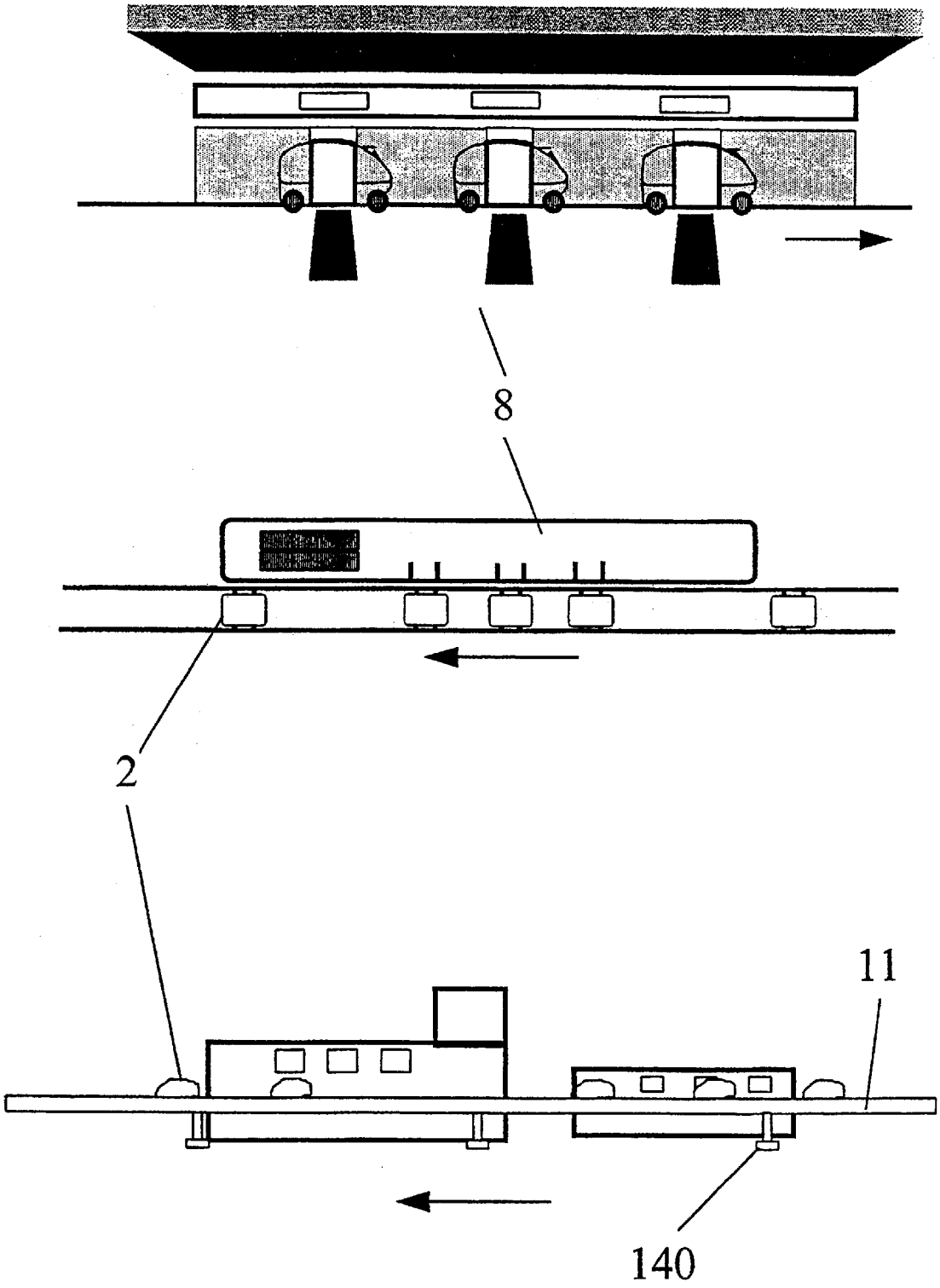

FIG. 31 illustrates a multi-gate station with queue-organising devices next to the gates to the vehicles.

Figure 32:
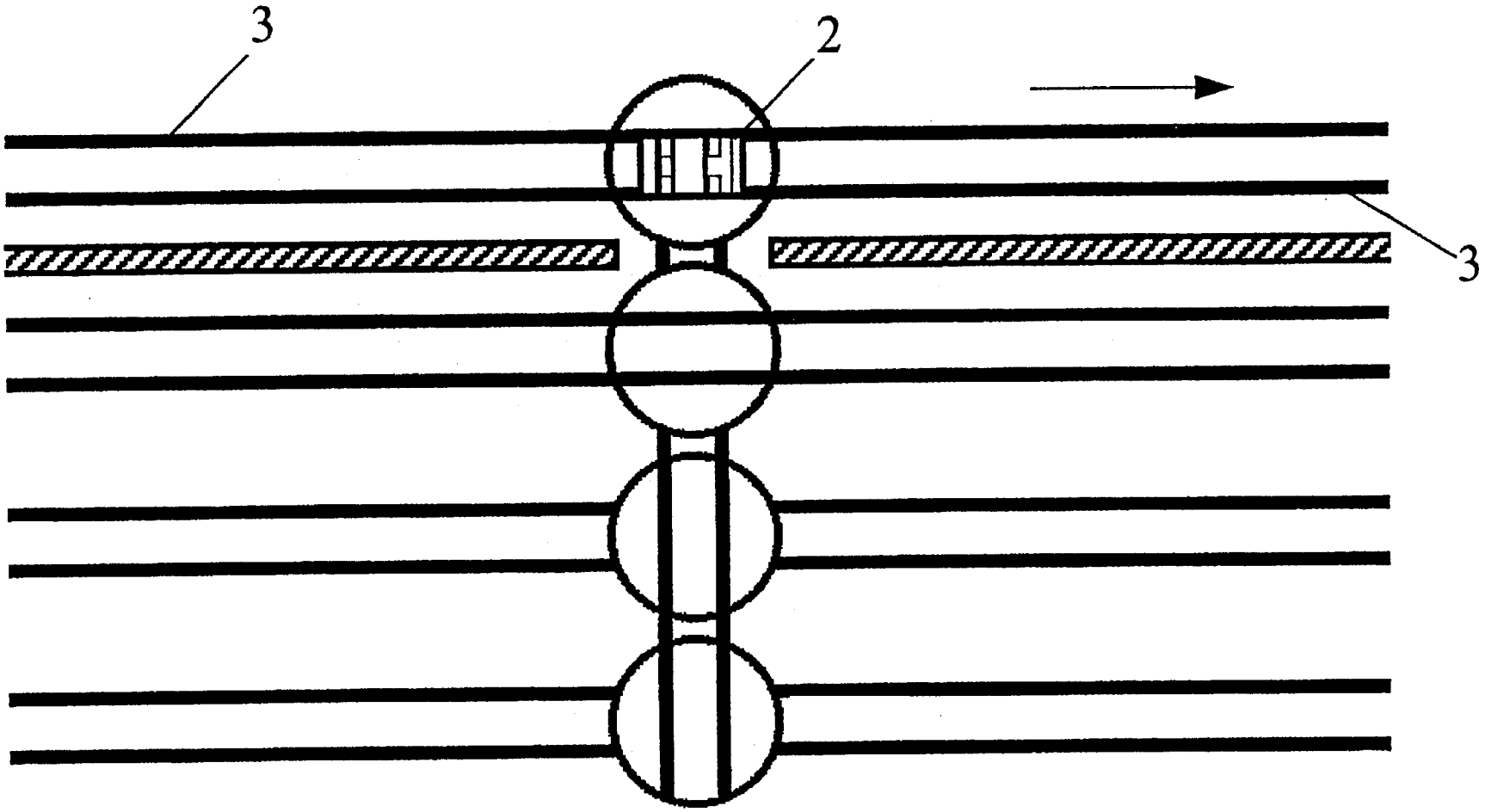

FIG. 32 shows a plane view of the principle for a floor of a parking facility, including an elevating mechanism arranged outside the outer wall.

Figure 33:
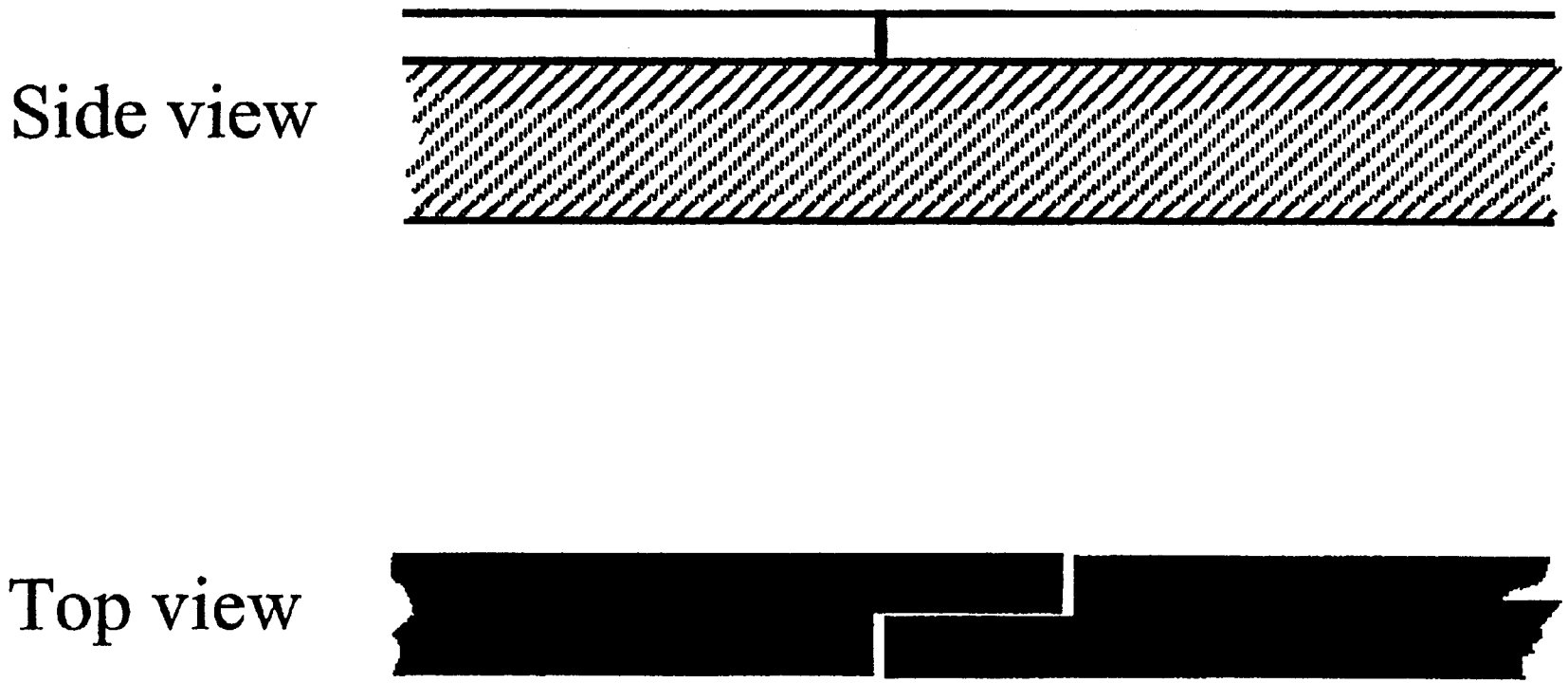

FIG. 33 shows in side view the top of the carrying beam in aluminium with a steel rail, and the same steel rail seen from above an arrangement for compensating the difference of the expansion factors of the aluminium beam and the steel rail.

DETAILED DESCRIPTION

A system according to the invention can fundamentally be described by the system being based on a main track with two parallel, along running, carrying beams (FIG. 4*a*): a left beam 11 and a right beam 11'. Each vehicle 2 is supported directly on the wheel axles 220 to four wheels 22, arranged two wheels on each side of the vehicle 2 (FIG. 4*b*). The axles 220 go through an open, along running, track 110,110', which form two partly closed and along running wheel cavities 110, 110' (FIG. 6), on the inside 111, 111' of the two beams 11,11' (FIG. 5). For the wheels 22, there is a rail 3, 3' in each track 110,110'. In the wheel cavities 110,110' there is also communication cables, electrical contact wires for power supply, in addition to a guiding rail 114, 114' on those parts of the track 1 where the vehicle 2 is to choose between continuing or making a turn. The vehicle 2 thereby travel between the two beams 11, 11' (FIG. 7), and achieve thereby exceptional stability and level of safety, opposed to the transportation systems according to known technology. These features allow designing the vehicles 2 with full height for standing passengers, and simultaneously keep a comparatively low total height. The reduced weight can be used to increase the number of passengers in each vehicle from typically 4 to 6–8 people (FIG. 8). The two beams 11,11' will typically reach up to the armrest of the interior chairs on each side of the vehicle (FIG. 9), and most wall surface above this will be made from glass. In the ceiling of the vehicle 2, there can be arranged a sunroof to be opened manually when the weather makes this preferable. The main advantage of this whole special arrangement is otherwise that the vehicle support system and the transfer of propulsion power becomes significantly simplified, and the engine (242 in FIG. 4*b*) and breaking mechanisms (not shown) can be installed directly under the seats 28' inside the engine compartment or under the baggage shelf 28 in the vehicle 2 (FIG. 8). This reduces complexity, lowers weight, lowers costs and improves serviceability. In addition, this means that each of the beams 11,11' only has to support (less than) half of the weights each, distributed on two points with 3–4 m distance. This has great beneficial consequences on the dimensioning of the beams 11,11', and the reduced dimensions will for example allow the use of extruded beams 11,11' instead of complex frame designs.

The challenges of such a system architecture becomes to design good solutions for the station 8, where both passengers and goods are to be transferred in/out of the vehicle 2, and additionally to design safe and quick switching mechanisms (shown by 6, 6λ, 6YR, 6YB, 6λR, 6Bλ, Bλ, and Cλ in FIG. 14 and in FIG. 15 by AyV, AyH, Ax, BλV, BλH, Bx, CλV, CλH and Cx). This application is about how the special arrangement, together with solutions for stations S and switching systems A, B, C together form a new and complete system.

Weight

The most important features of a Skyway system according to the invention are functionality and safety, but the main cost driver is weight. There are three main physical components in the system, vehicles 2, beams 11,11' and posts 140. The track 1 consist of beams 11,11' and posts 140, and stations 8 are distributed next to the track. A track segment can be defined as the "T" a post 140 form with the beams 11,11' on each side, halfway to the two next posts 140 (FIG. 10). The system is in the simplest configuration thought realised by the vehicles 2 holding such a distance that there are always (less than) one vehicle 2 for each track segment.

The sum of the weight of a track segment and one vehicle 2 then give the maximum weight load for each post 140. This weight will determine the dimensioning of the foundations for the post 140. There are large cost-wise consequences if one can have "floating" foundations (not shown) in stead of having to drive poles into the ground. One kilo in the vehicle 2 is thereby equally significant to one kilo in the beams 11,11' or one kilo in the post 140, and using costly materials can be worthwhile, as long as weight is saved.

Vehicle

The vehicle 2 weight is therefore very important for total system cost, and all solutions, which reduce weight, are important. For example, one can leave to the stations 8 to carry the weight of the door-opening arrangements, and likewise to hold an arrangement that push the vehicle 2 when starting, allowing lighter on-board engines.

Light vehicles 2, for example made from Aluminium and composite materials and having a weight of typically 500 kg and be designed for typically 700 kg of load. This loading capacity could be used to transport 6–8 people or for container-based goods transport. Inner vehicle measurements could be typically width 2.0 m, height 1.9 m and length 3.6 m. The vehicles would have large window surfaces which would provide good views, and the vehicle would be designed for providing full standing height, having a combination of fixed seats and folding seats. The design of the vehicles 2 would allow transport of up to four wheelchairs, baby strollers and bicycles.

Ease of maintenance is important, and the use of rubber wheels is thought to be unpractical. It is therefore probable that one will choose to use wheels 22 that have a wear surface of steel, which roll on rails 114,114' of steel inside the along running track 110,110' of the beams 11,11'. One can choose to arrange the steel rails 114,114' on a rubber mat to reduce noise levels. Likewise, one can choose to make the wheels with partly flexible wheel spokes. The wheel spokes will then perform the dampening that the rubber wheel normally supply. The axle or axles 220 between the wheels 22 will further be fixed inside the vehicle using a dampening arrangement.

First generation vehicles 2 will therefore probably be based on wheels 22, most probably steel wheels rolling on steel rails 114, 114', where one or more electric engines 242 propel at least one of the wheels 22. It is thought to be one wheel 22 in each corner, where the axle 220 of the wheels 22 simultaneously carry the vehicle 2. At least one of the wheels 2 must have a breaking arrangement. In a future version, one can imagine the use of linear engines for propulsion, and finally maybe replace the wheels 22 with an electromagnetic levitating arrangement. Electric engines 22, and particularly linear engines, can be used to provide breaking, and partly also for recuperating parts of the dynamic energy back in the form of electric current.

From weight considerations, one can envision seats 28, tables, etc made from Magnesium frames, and that the shell of the vehicle is made from Aluminium, where an independently carrying structure simultaneously provides an esthetical outer design. Regarding the windows, strength and weight will be important, price less so. One will probably also find that the total energy consumption will be minimised by insulating the vehicles somewhat less than normal for other vehicles and rather use some more (weightless) electricity for heating/cooling of the vehicle 2 air.

Passenger comfort is highly appreciated. A preferred embodiment of the invention of the vehicle 2 and rails 3,3' must be arranged to give little vibrations by having a high degree of precision in rails 3,3', combined with a good dampening arrangement in the vehicles 2, noise-dampening suspension and resonance-dampening arrangements in the vehicle 2, in addition to a well functioning ventilation system, high levels of safety and god viewing visibility, features that belong to known technologies for vehicles.

A possible embodiment of the vehicle 2 has a combination of three fixed seats 28 in the back related to direction of travel and two fixed seats 28 in the front with tiltable backrests (FIG. 8). Next to the two inner fixed seats one can arrange a fixed table designed for folding down. Between these two tables, there can be room for a folding seat 28', and likewise between the two front seats 28.

One will always exit the vehicle 2 on the right side, and the door 30 must be designed to be wide enough for allowing entering passengers to pass those who exit (FIGS. 8 and 11). Average time at stations 8 required for each vehicle 2 which stop will then typically be 8–12 seconds. In countries where cars is driven on the left-hand side of the road, it will probably be practical that "Skyway" drive on the left-hand side, with the door opening to the left of the vehicle.

The vehicle 2 is further thought realised having four safety arrangements in the general area above the wheels, which lie above the beams 11,11' on each side (FIG. 5). This will prevent the vehicle 2 from falling down in case one of the axles should break or the vehicle 2 should be running off the rails. In addition to providing technical safety, such an embodiment would also contribute to an increased perception of safety among passengers.

Track

The track or rail 3,3' consist of two steel rails 114, 114' arranged one each inside the wheel cavity or open track 110, 110' in each of the beams 11, 11' (FIGS. 4*a*, 4*b*, 4*c*, 5). The wheels 22 of the vehicle 2 will have railroad-type flanges 22F on the outer part of the wheels with relationship to the vehicle 2. The flange 22F averts derailing. If a steel rail 114, 114' is arranged for example on Aluminium beams 11, 11', it will be necessary to take care of thermal expansions.

The two parallel beams 11,11' will typically be made from light metals and be sufficiently elevated from the ground to minimise esthetical interference and avoid conflict with ground-based traffic. This will typically be 5–6 m above ground so that the outer floor 210' of the vehicle is 5–6 m above ground. The width of each of the two parallel beams 11,11' can be about 0.5 m and the height 0.8 m. The load-carrying element in each beam 11,11' can be an I-bar, and the beams 11,11' can comprise a surface sheet of Aluminium for protection against rain, snow and ice. If this outer surface were to reflect light, it would further minimise visual esthetical interference from ground level, because such a surface would to some degree mirror clouds and sky, and thereby appear less intrusive. The posts 140 can be made from light metal or other practical and light material.

A heating arrangement can be built inside the surface sheet of the beams 11,11' to prevent ice formation, and the beams must have holes in the bottom to allow water to come out, and to provide some ventilation.

On the top of each beam 11,11' there can in the preferred embodiment be an along running hollow chamber where the one is meant for data cables/fiberoptics for the communication needs of the system itself, and the other intended for supporting fiberoptic cables for datacommunication, television, telecommunication or other information, as a cost-effective alternative to digging these into the ground. This would be particularly relevant for providing high-speed communication to the buildings next to the beams 11,11' and next to stations 8.

Weight is a central term. At a speed of say 45 km/t and a 2.5 seconds time spacing, the distance between vehicles 2 would be 30 m. Holding four or six passengers in each vehicle 2, the capacity of one track would be respectively 5.760 and 8.640 passengers per hour. This is comparable to the capacity of a four to six lane highway (FIGS. 12,13), and represent a higher capacity than both bus and train. If each post is spaced each 15–25 m, one would then only have one vehicle 2 for each post 140 and track segment at a time. This will be a fundamental equation in the dimensioning of the track.

The track 1 will typically be installed above ground above sidewalks, roads, highways, bridges, railroads, and agricultural areas, along ridges or passing rivers or canyons. But the track 1 can also be installed on ground level, go through underground tunnels or dedicated "holes" in buildings.

Switching Arrangements

To be able to build a network (FIG. 14) and make non-stop transport possible, it is necessary to be able to let one track 1 split into two (a Y-junction) (FIG. 15), and for two tracks to be joined into one (a λ junction). The letter "λ" is used to illustrate the shape of the junction where two tracks 1 join into one track 1. To let two tracks 1 join into one track is possible with no moving parts (FIGS. 16, 17, 18, 19, 20, 21). But in order to sending the vehicle either to the right or left (alternatively straight-ahead), active mechanical (or active magnetic) arrangements are required. The moving parts can either be part of the track 1 or the vehicle 2. In both cases they are in the preferred embodiment of the invention computer controlled.

The first rule in the preferred embodiment of the invention is safety. A vehicle 2 going off the tracks 1 is absolutely and definitely unwanted. Thereafter it is paramount for a PRT system that the system allow vehicles 2 to travel close after one another, as this directly impacts the maximum capacity of the system. As people get used to travelling the system, one can gradually decrease headway, in principle to sub-second time distance. In such a case the beams 11,11' will have to be dimensioned for increased load, and one can envision that in the future that some long-haul tracks 1 will be dimensioned for sub-second headway, while feeder-tracks maintain at least 2–3 seconds headway to allow more affordable beams 11,11' and greater perceived levels of safety.

If a system contains relatively few switching junctions 6Y and a large number of vehicles 2, active tracks AY can be the best choice, while in a network with many track junctions 6Y relative to number of vehicles 2, active guiding arrangements 6S (FIG. 23) in each vehicle 2 becomes more attractive.

FIG. 22 shows a typical configuration of an off-line station 8, based on vehicles travelling on the right-hand side. First there is a AY junction allowing vehicles 2 to leave the main track. It then arrives at a B junction that joins a parking track for available vehicles with the off-line track. The stations 8 can have several gates. The track 1 from AY to the station 8 is for deceleration. After the station 8 there is an acceleration track to the c junction, which connect the off-line side-track with the main track again. All these track junctions A, B and C can be designed with one straight main track with outgoing or incoming side tracks. The advantage with such an arrangement is on the one hand to allow vehicles 2 freely to move back and forth on the straight track without having to use the guiding arrangement 6Y or 6s. This is functionally convenient for allowing vehicles 2 to travel back and forth between the station 8 and the parking track without the need for active switching, and it also increases safety by for example allowing a vehicle 2 to continue on the main track if the guiding arrangements are not activated.

Active Guiding Arrangement in the Vehicle

The most probable switching arrangement will have to have the active control inside the vehicle. Here one can use a car as a metaphor, as it is "the car itself" that decide where to go. A most probable system for allowing the vehicle 2 to choose between the right or left track, is to have an "in-vehicle-switch". This means that the active element is inside the vehicle itself. In the Skyway system there are to be two guiding arrangements 6s, one next to each pair of wheels 22, 22', which in a AY junction latches onto a guiding rail 114,114' inside the beams 11,11' through vertical holes on each side of the vehicle 2. Each vehicle guiding arrangement 6s is supplied with a guiding wheel 66s,66s' in each end, so that when the guiding arrangement 6s is in the horizontal position, the guiding wheels 66s,66s' can spin freely, lying in the horizontal plane (FIG. 23).

As soon as the vehicle 2 has passed a AY junction, both vehicle guiding arrangements 6s will be locked into the position they must have in the next AY junction AY, B, C. If one of the two guiding arrangement 6s is stuck, the other guiding arrangement 6s is locked into the same position as the defect one. This vehicle 2 can then be guided through the track network to the first available station 8 for repair. If both of the guiding arrangements 6s should be locked in different positions, breaks are immediately applied. This control sequence would only require a few seconds, and if the AY junctions were at least 100–200 m apart, vehicles could break and stop in case of failures and thereby avoid accidents. Normally both guiding arrangements 6s would quickly be in the correct position, and when approaching the next AY junction, the guiding rails 114,114' (FIG. 25) would gradually appear (relative to the vehicle 2) in both along running tracks. The pair of guiding wheels 66s, 66s' on the guiding arrangements being in the uppermost position would gradually latch onto the corresponding guiding rails 114, 114' and pull the vehicle 2 gently, but firmly in this direction, and thereby guide the vehicle 2 safely in the right direction. After the vehicle 2 passing the junction, the guiding rails 116, 116' would again disappear (relative the vehicle 2). The guiding rails 114,114' are shaped in such a way that the guiding wheels 66s,66s' are not able to loose their latch-on during a turn. This way, all required physical movements would be performed and verified in good time before the vehicle 2 enters the junction, and no activities would thereby be time-critical. In principle, vehicles 2 could therefore travel with only a few centimeters of headroom, and still be safely guided to their individual destinations. It is not strictly required to have a complete guiding arrangement 6s, because independent arrangements for each guiding wheels 66s,66s' would be possible. But the advantage of the complete guiding arrangements 6s, is that when the on end is up, the other end is automatically down. This would also be easy to verify by the use of robust mechanical switches or by the use of other sensors.

A critical issues for a switch is cold, with snow and ice, because the switches could be locked into an unwanted position. By only using passive rail switches (6Y, 6λB, 6λC), the number of potential problems is significantly reduced, even though some heating arrangement might still be required in track junctions for the melting of snow or ice, because parts of the rails 3,3' will be exposed while being lead from one pair of beams 110,110' to the next. By installing the guiding arrangements 6S together with the wheel axles 220, the breaks and in one instance also the engine(s) 242 inside the vehicle, and simultaneously ventilating used air from the inside of the vehicle 2 through these compartments and out through the holes (FIG. 26) for the guiding arrangements 6S, icing would not be a problem for the active guiding arrangements. Service and maintenance could easily be performed through hatches inside the vehicle. With active guiding arrangements 6S installed inside each vehicles 2, all track junctions (6Y, 6λB, 6λC) could be "passive", i.e. with no moving parts. As the Skyway system is thought to be installed also in less industrialised countries, it is particularly important to use robust technologies that can be both understood and maintained by local employees.

Active Track Guiding Arrangements

Alternatively one can choose to have the active guiding arrangements integrated in the tracks. Here it is natural to use railroad technology as a reference, as rail switches in that case guide the trains to destinations. The only active junction is similarly the AY junction, that can be imagined designed as if a few meter long track segment had been cut away. Using a hinged switching arrangement (FIGS. 27, 28), or utilising a side-moving arrangement (FIG. 29), one would, utilising this track segment switching arrangement guide vehicles to the one or other direction.

Such an arrangement would not require any guiding arrangement in each vehicle. The disadvantages would be that the moving track segment would be exposed to the elements, and would require separate care to avoid freezing in winter. Maintenance would also be cumbersome. In addition, these physical movements would also require some amount of time, which again would require of the vehicles 2 to travel with large headway to allow the switch to be set and verified in the right position in good time before any vehicles 2 arriving.

It is fully feasible to design such a switch for allowing a vehicle 2 to fall onto a straight and underlying pair of rails if the switch was not properly set, providing the main track was going straight ahead. The underlying safety rails (not shown) would be arranged in such a way that the vehicle 2 by its own speed would continue straight ahead and somewhat upwards, and then fall down again on the main track. It is however envisioned that utilise in-vehicle switching by means of guiding arrangements 6S inside the vehicles 2, being the simplest and most functional embodiment.

Stations

Figure 1:
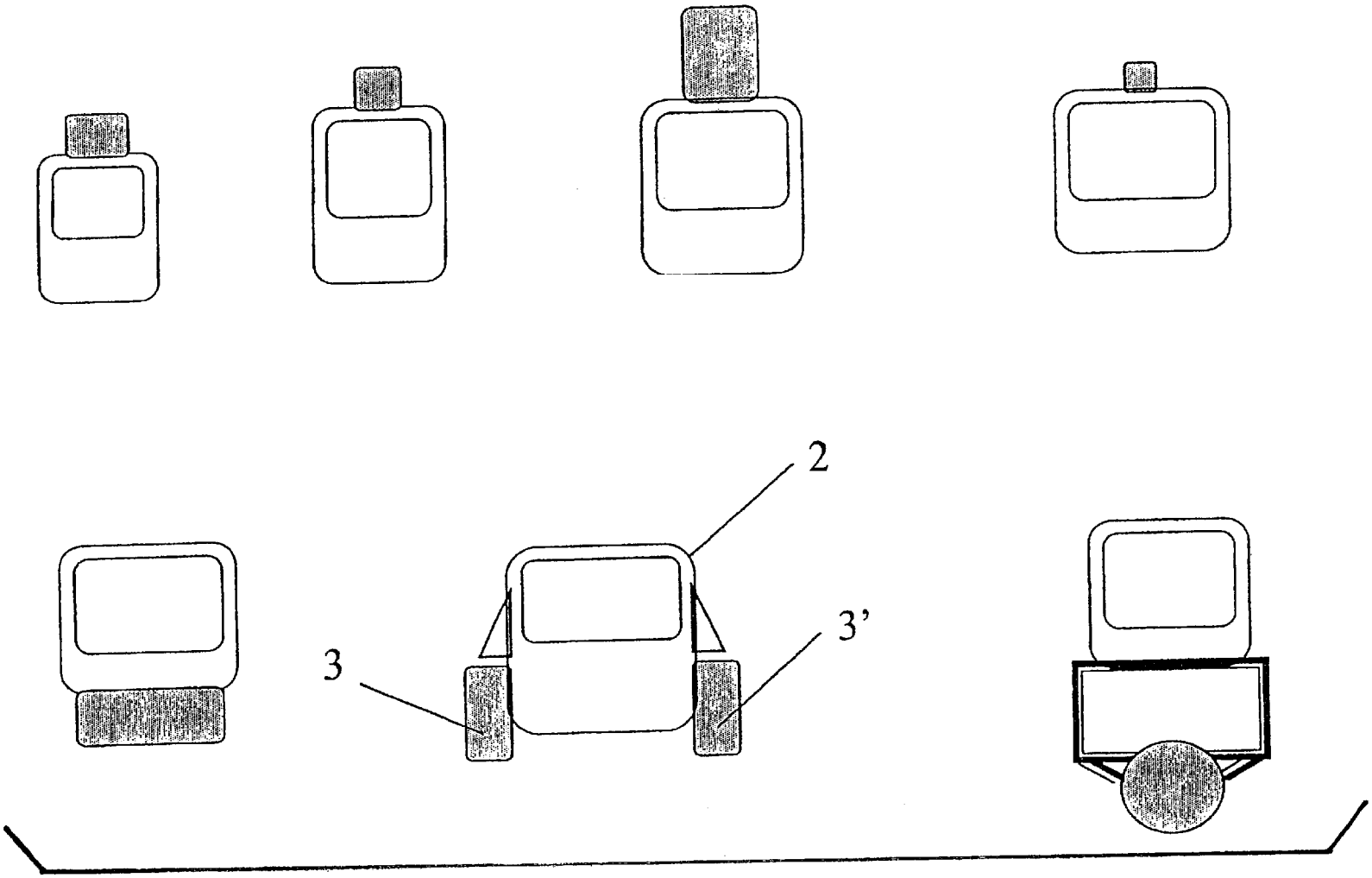
FIG. 1 shows different PRT concepts.
Figure 2:
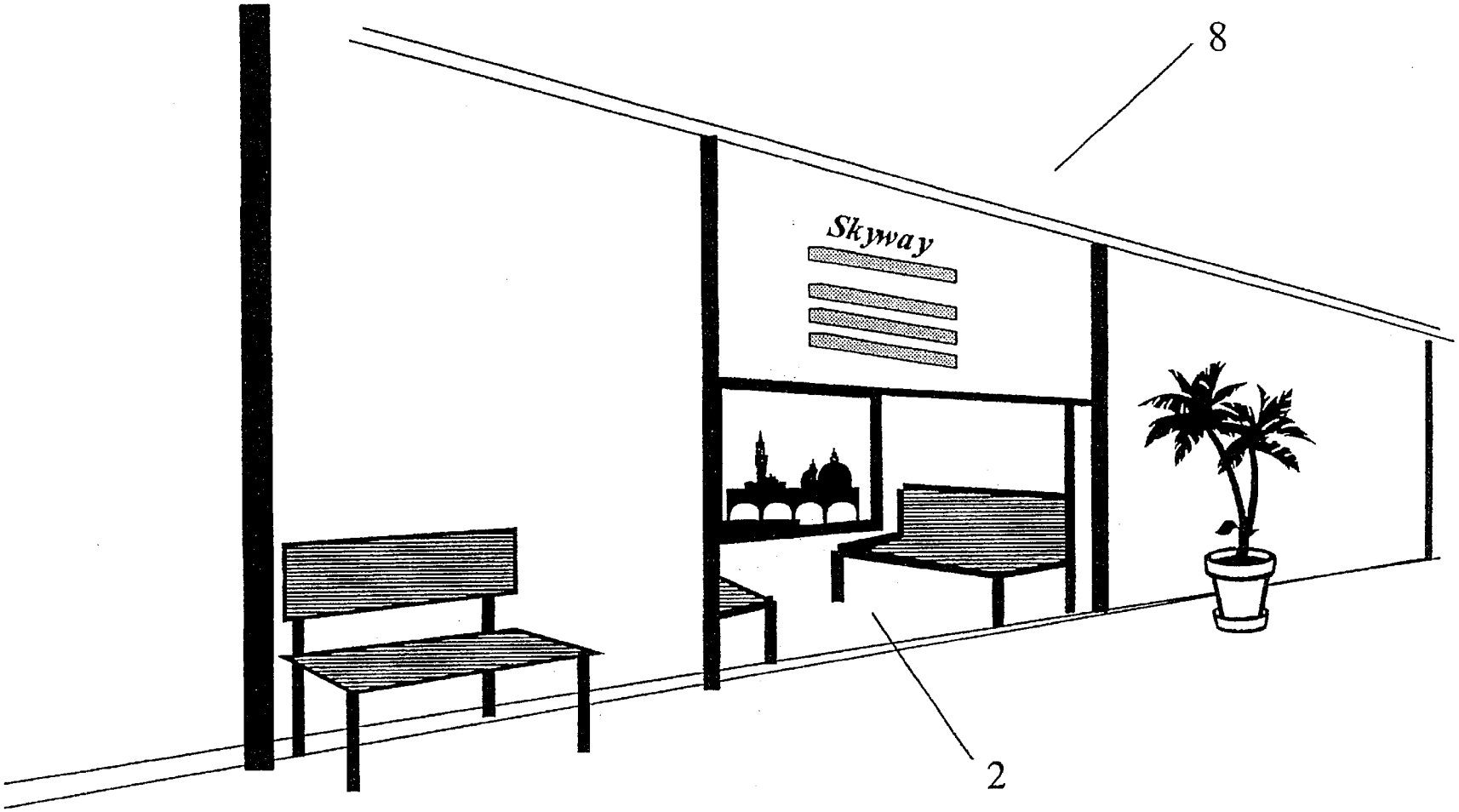
FIG. 2 shows a sketch of a typical station in a transport system according to the invention.
Figure 3:
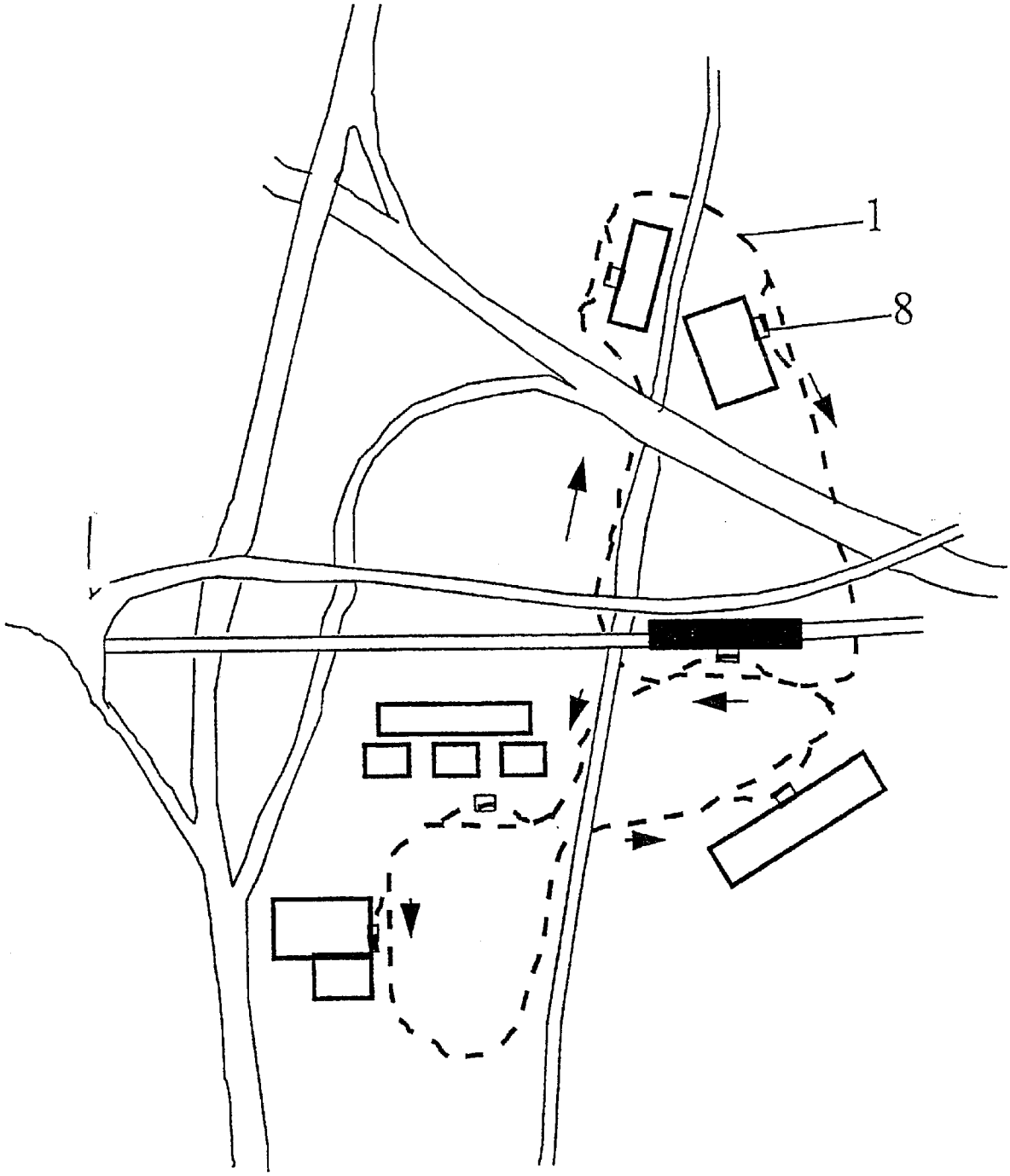
FIG. 3 shows a single PRT network with off-line stations according to known technology.

FIG. 2 shows one possible layout of a station 8. The station 8 will typically be installed in the second or third floor of existing buildings such as housing complexes, centres of activity, office buildings, institutions, schools, day-care centres, etc. At a station 8, on the side of the door (in Norway on the right-hand side), a section of the beam 11' will disappear where the door is opening, and the rail will be installed across the in- and out-pathway for the passengers (FIG. 30). When on the station, power is supplied to the vehicle 2 from the left beam.

The doors 30 are to be wide enough to allow simultaneous embarking and disembarking of the vehicle (FIG. 11). In Norway, embarking would be on the right-hand side, and disembarking on the right-hand, and the other way around in countries with left side driving.

To save weight in each vehicle 2, an arrangement in the station 8 will open and close the doors 30 of the vehicle 8. The doors 30 are hinged in the vehicle 2, and will open towards the station 8. These two doors then form the walls in a short (the length of the doors, about 70 cm) corridor 30' into the station 8 (FIG. 11). The doors 81 of the station 8 itself glide to the sides behind a screen or window, synchronised with the opening of the vehicle. 2 doors 30. To ensure the vehicles 2 do not travel overloaded, weighing arrangements and indicators will be installed in all stations.

During peak hours when all vehicles are used, traffic will tend to be unidirectional; i.e. people are travelling from living areas to working areas. Seldom people will simultaneously embark and disembark at the same station 8. Utilising wide doors 30, short stopping times will be required. An average stopping time for vehicles 2 at stations 8 is envisioned to be in the order of 8–12 seconds. During peak hours, vehicles will typically leave a station gate 81 every 15–30 seconds, depending of how many gates 81 there are after one another at the station 8 and how many vehicles 2 are available.

To increase station 8 capacity, one can install more station gates after one another for vehicles at the same station or off-line track (FIG. 31). The total station capacity per hour will typically be, with number of gates shown and 4 passengers in each vehicle 2: capacity per hour will typically be, with number of gates 80 shown and 4 passengers in each vehicle 2:

| | |
|---|---|
| 1 gate | 1000 passengers/hour |
| 2 gates | 1714 passengers/hour |
| 3 gates | 2250 passengers/hour |
| 4 gates | 2667 passengers/hour |
| 5 gates | 3000 passengers/hour |

By allowing 6–7 passengers in each vehicle 2, capacity is increased with 50–100%. Capacity numbers are comparable to multi-lane highways, train and subway, but at significantly lower cost.

The increased capacity of one extra gate 81 will decrease with the number of previous gates, and more than 4–5 gates at one single station 8 are probably not worthwhile. If capacity needs to be increased further, the system needs to be designed for more passengers per vehicle 2 or one must increase number of stations 8. But since one of the purposes of a PRT system is to be able to have a high density of stations, that is no problem. On tracks 1 with little traffic, it is probably cost-effective to allow stations 8 to be directly on the main track 1, while tracks with high traffic volumes will have stations 8 on off-line tracks.

Arrangement for Starting of Vehicles

Electrical rotary engines have the characteristics that they can deliver their power over a wide range of rotation speeds. But for use in vehicles, the engines must be dimensioned for maximum required power levels, which correspond to the power required for accelerating the vehicle. Particularly, it requires much power to get a vehicle going from standstill. Simultaneously, it is clear that one want to avoid gearing systems in each vehicle. Since vehicles 2 are normally only to start from standstill at stations 8, it can be advantageous to have an arrangement in each gate that gently starts the vehicle 2 to a speed of 3–4 km per hour, about 1 meters per second. Such an arrangement would allow significantly smaller engines in the vehicles 2, with consequential advantages for cost and weight. If vehicles 2 were to stop on the track, it would be acceptable for passengers that the vehicle this time accelerated very slowly. Given such a starting arrangement on each station 8, the engines could be dimensioned according to power required for propelling vehicles 2 with required speed up the steepest slope of the track 1.

Integrated Elevation Arrangement

On some stations 8 it can be convenient to integrate a vertical elevating arrangement for vehicles 2 in one or more of the station gates (FIG. 32). By being able to elevate the vehicle 2 to the required floor, a system for transportation from any floor of one building to any floor of another building would be feasible. This arrangement will possibly be included, particularly in new buildings.

Distribution of Empty Vehicles

At many stations 8 it would be advantageous to be able to park empty vehicles 2, being ready for use on demand. Only to a limited degree can they be parked at a gate because other vehicles 2 might need to use or pass this gate. By introducing a junction, a short, dead-end track section can be added at the station 8 where vehicles can be parked in attention (FIG. 22). One can choose to allow the vehicles 2 the feature of backing, but this would increase cost, weight and complexity of each vehicle 2. In stead, one can introduce a parking arrangement (not shown) in the station 8, where some sort of mechanical "arm" latches on to the vehicle 2 and move it to its parking place. For example, one can have a number of such "arms" at each station 8 equalling number of parking spaces. This arrangement can be designed in such a way that the arms need to be 4 meters equidistant when moving or in parking position, so that the vehicles becomes nicely parked after one another. Alternatively, one arm can park each vehicle 2, and the vehicle in front drives slowly forward when required.

The Human Factor

In an automatic PRT system, a main point is that there are to be no drivers. But in many instances it is important to remember to introduce human factors, and it is probable that there will be a number of station Masters. Some stations 8 will be permanently manned, other stations semi-permanently, particularly during peak hours or during the times of day when the system is used by children to or from schools and kindergarten. An automatic system shall be self-sufficient, but there are still more reasons for human involvement. Some passengers will require assistance and tourists will probably increase system use if they are offered help and advice.

For example, it can be sensible for a station Master to check that each vehicle is OK and empty before sending it to the parking track. The station Master can also keep an eye to who enter the vehicle and if the vehicle is OK when people are leaving. Random ticket controls can also be required. The station Master can for example have a display in the station 8 that show how many passengers are supposed to be in an arriving vehicle, how many is to disembark and how many are to proceed.

Computer Control and Functionality

The computer system can be decentralised and distributed. Each vehicle 2 will in such a case have on-board computer and software, with clearly defined interfaces to other computers in the system. All vehicles will know their own position, the position of all other vehicles and the destination of each. The required data communication can be wireless, via a distributed antenna ("leaky" cable) in the wheel cavity, via fixed lines to each station 8 or by a combination of the above.

One will probably allow asynchronous transport of vehicles 2 on the track, but synchronise vehicle traffic at track junctions, i.e. where two tracks are joined into one track. Some time before a vehicle 2 is to pass a track junction, it will reserve the first free time slot it can use for going through the track junction. All vehicles will have information about all such reservations, and will adjust its own speed accordingly. Each track junction will have its own computer for surveying possible vehicle conflicts at its own track junction. Likewise all track segments, or groups thereof, will have a dedicated computer, and also all stations 8 and an operations surveillance central. These computers will with present technology be quite affordable, even though they will hold and process much information.

Sensors along the track will provide vehicles exact positioning information, as a supplement to calculated position. This is of particular importance near track junctions and at stations 8. The operations surveillance central will be able to override the route of each vehicle 2 and will also be able to assign vehicle 2 priority through track junctions.

Initially, a track segment will be designed for a particular speed, with fixed curvature and tilting of curved sections. This means that it will be the track section that will assign the maximum speed to vehicles travelling on that track section. The vehicles 2 will only have the power to reduce speed. If the computer in the track segment find possible conflicts, propulsion power to vehicles will be turned off, and the computer in each vehicle will apply vehicle breaks. As an additional feature of safety, distance sensors can be introduced into each vehicle. In addition, a sealed and manual emergency break will be provided for each vehicle 2, so that the passengers also have the power to stop a vehicle. There will always arise emergency situations, which are not possible to foresee, or that are not practical to assign a technical solution, and it will therefore provide passengers with additional safety to allow them to be able to stop the vehicle by themselves. The emergency break release must be arranged in the vehicle so that children could release it. By releasing the emergency break, vocal communications would be established between the vehicle and the operations surveillance central, so that necessary precautions could be taken. A separate intercom for conversation with the operations surveillance central would be provided in each vehicle an extra safety feature. Violator would anyhow not be able to escape without attracting attention, so misuse of above features would be a minimal problem.

The system would be able to operate both in Mini-GRT mode and in PRT mode, in addition to intermediate modes. This means that a passenger either could travel alone non-stop, with others on a fixed route or with others from one area to another area.

In rush hours (maximum traffic load) one might offer passengers the opportunity to share a vehicle, by having the computer calculate a route for the vehicle that collect passengers from one area travelling to one destination. During rush hours, it will probably be expensive to travel alone. Outside of rush hours, there will always be empty vehicles available. Some of these will be ready next to stations and some will be parked in special garages. But some empty vehicles will also be "parked" moving around in the system, or being on the way to stations 8 according to anticipated demand. In this case, theory about "learning computers" can be applied.

Power Supply

Both beams 11,11' contain in the wheel cavities contact tracks for current delivered from a central or distributed power stations. Each vehicle has on each side a collector shoe or trolley shoe to be able to receive the electric power. Having these on both side of the vehicle is both for achieving greater reliability, but also for example because vehicles on stations 8 only can pick up the current from the left-hand side, and in junctions only from one of the sides.

One can choose to have current delivered from a central power station, introduce a cellular power supply grid, or to deliver power from buildings along the track. Typically, 20–40 vehicles is estimated pr station 8 in the system, totalling something like 50–400 kW of power required in average for vehicle propulsion per station 8. This is too much to drain directly from nearby buildings, but still within reason by installing extra circuitry locally.

Goods Transport

Most transportation infrastructure systems are dimensioned for a particular maximum capacity. The transportation of people in cities normally peaks at rush hours, when people are travelling to and from work. This means that there will be free capacity outside of rush hours, available for example for the transport of goods. This can be performed by delivery people using the system, but also fully automatic is possible. Each vehicle 2 having inner free floor surfaces of approximately $1.5\times2.0$ $m^2$ and an inner height close to 2 m, will provide close to 6 $m^3$ available for goods transport. Maximum load will typically be in the order of 700 kg, so 6 $m^3$ should be quite sufficient, eliminating the need for removal of seats. Authorised transportation firms would then order vehicles to required stations, and then send the goods without human companions to destinations. Special goods stations would be integrated into warehouses and automated containers would be developed, so that goods eventually could be shipped automatically from any shelf in one warehouse to any shelf in another warehouse.

To further even out demand in the system, differentiating pricing schemes would be introduced, so that it for example would be most cost-effective to ship goods at night. Low noise levels would then be of paramount importance.

Parking

Outside of peak hours, there would be spare capacity. This would mean that more people would use a vehicle exclusively for themselves, but there would also be unused vehicles in the system. Some of these would be waiting at a gate in a station 8, and some at the associated parking track. But in addition, there would be a need for dedicated parking facilities, in particular if private ownership of vehicles were to be permitted.

Arranged after one another on a track, a vehicle 2 would require in the order of 4 m of track, and this length of track would in itself cost in the order of the same as the vehicle. More affordable and compact parking facilities would have to be developed. A Skyway parking house (FIG. 32) would incorporate the same elevating arrangement as one can choose to have on building with stations 8. The vehicle will stop on the elevating arrangement integrated into the building and be lifted to the appropriate floor. When on the appropriate floor, the vehicle is transported sideways into the building on a parking platform (not shown) rolling on a separate pair of wheels (not shown) The parking platform can move sideways in the garage, while the vehicles can move back and fort. If vehicles are not able to propel themselves backwards, one can install one elevating arrangement for vehicles going into the garage, one way parking inside, and another elevating arrangement for vehicles going out again, and thereby facilitate very compact and efficient parking. Vehicles parked on lower floors will be quickest to retrieve again.

Special Services

In cities such as for example Bangkok, one is in deep trouble if caught in an accident. Streets are so congested that it will take long time before help can come to the scene. In such cities, one can equip special emergency versions of the vehicles, where the floor of the vehicles by means of a special arrangement can be lowered 5–7 m to street level. Here, paramedics can give first aid, before the patient is lifted into the vehicle and driven non-stop to the hospital station. When driving non-stop, a speed of for example 45 km/hour is quite rapid. The same kind of emergency vehicles can also be used by other public services such as police and fire-fighting units, etc.

As the width of the vehicles is ca 2 m and total weight included passengers will be somewhat above 1200 kg, one can also envision special transport vehicles, almost as transportation "platforms", which can transport special containers or even move smaller cars.

Safety

Fundamentally, the system is to be designed for passive safety. This implies that the vehicles always will move with a minimum distance to each other, so that they can not collide. For example, one could design each track segment in such a way that if two vehicles 2 were to be on a track segment simultaneously, power supply is cut off to both vehicles. The breaking arrangement in each vehicle would be designed using fail-safe philosophy. That means that everything must be in order for breaks to be disengaged. The breaks are by default engaged, mechanically forced by an arrangement of springs. When everything is confirmed in order, an electrical arrangement is activated that disengage the mechanical spring. If power is cut, the breaks are thereby automatically engaged mechanically. Using this type of design philosophy, one can allow building the vehicles with a minimum of (emotionally rationalised) fender arrangements, without the use of deformation zones. Such measures will dramatically reduce weight and energy consumption.

Technical errors or failures can still happen causing vehicles 2 to a standstill with breaks engaged on the track. For such cases, there will always be a modern rope ladder under the baggage shelf behind the back seat of the vehicle. By means of releasing a sealed opening arrangement, one will be able to open the back window and if required climb down to the ground. Special alarm lights will then warn surface traffic of the emergency situation. Normally, a special evacuating vehicle 2' would be dispatched that the passengers would be assisted to move into.

One could also utilise for example laser-based technology or other sensor technologies for automatic monitoring of possible damages of the beams 11,11' caused by the posts being hit by ground traffic.

Further, it would be natural to use the human element, and thereby include social systems into the safety concept. From the vehicle 2, it would be possible to talk to an operator at the operations surveillance central. The operations surveillance central could for example if required redirect the vehicle 2 to travel non-stop to the hospital. Random sound surveillance of vehicles would also probably be accepted by passengers, provided physical violence from fellow passengers showed to be a problem. Not the least, the windows of vehicles 2 must be so large and transparent that people on the street or in nearby buildings also would keep an eye that everything was all right with the passengers. Each vehicle 2 would have clear identifying numbers, and if suspicion arose, watchers could call the operations surveillance central which in turn would contact the vehicle.

At least one station 8 in the system would have a permanent staff. To this station would be redirected every vehicle where passengers had pushed a distress button, and no connection the vehicle and the operations surveillance central could be established. The same would happen at signs of unrest, vandalism or violence. By initially broadcasting widely that all wrongdoers automatically is dispatched into the arms of the police, troublemakers would find other arenas for expression. Technical systems do not solely require technical safety, being as they are part of a social system, which can form an integrated part of providing safety.

At a later time, one or more video screens could be installed in each vehicle, showing for example tourist information, advertisements, or providing contact with the operations surveillance central. Video surveillance could be required.

Vehicles would allow the use of mobile phones.

Maintenance

It is very important to have a good system for technical surveillance, quality control and maintenance. The vehicles would automatically and periodically visit special "Washing machines" and maintenance garages for the vehicles. Further, special "track maintenance vehicles" would be developed for automatic quality control and maintenance of tracks. This vehicle would, as all other vehicles, by means of positioning technology always know its position in the system. It would utilise special accelerator sensors for determining the quality and straightness of the rails.

Aluminium and steel has for example differing thermal expansion factors, and the steel rail will probably have expansion openings (FIG. 33) that would allow some movement. But there would still be a need for adjustments, both laterally and vertically. The rails and beams could be designed for automatic adjustment by the maintenance vehicle, within mechanical tolerances. By larger discrepancies, maintenance personnel would be called upon.

From Passenger Perspective

The Skyway concept is based on a philosophy of choosing the right level of complexity, choose "high-tech" where appropriate (Materials technology, computer technology) and "low-tech" where appropriate (concept, propulsion, switching). The system is supposed to be so simple to use that it will appear somewhat boring and taken for granted.

On a station 8, the passenger will meet the ticket machine. There he can push a button on a map symbolising his destination stations 8, and he will be asked for differing pricing schemes, for children, adults, etc. Three choices will be provided:

1. Taxi-mode were he will travel alone or with his own party.
2. Mixed mode where he accept to share ride with fellow passengers leaving from the same area as he is, and going together to another area.
3. Route-mode where he accepts to stop on other stations for picking up passengers going along the same route.

For these three alternatives, he will be provided with information on departure time, arrival time and price. When having paid, he will be issued a ticket with the appropriate information, in addition to a reference number and the number of the gate of departure.

If having a customer card, this will have to be inserted in the machine before destination is selected. On this card is pre-programmed all information on preferred prising scheme and possible discounts. For passengers with established customer relationship, booking of tickets will also be available via telephone, mobile phone and on the Internet.

Above each gate inside the station 8 there is an information display showing the next 4–6 departures; time of departure and a reference number. When the correct vehicle 2 arrives, the passenger embarks. If he does not show up, a new ticket needs to be bought.

It will not be very helpful for others to board a vehicle, because destination is not supplied on the information display, and you could be exposed to random ticket control at destination.

It will also be permitted to book a repeating ticket, for example for repetitive travels to work, school, kindergarten, etc. For such travels, special customer cards will be issued, and one vehicle can for example accommodate several children travelling to the same school. In such cases, the station Master will provide advice and safety control.

The Core of the System Invention

Fundamentally, the invention consist of a new concept, a new arrangement for automated small vehicles, by the use of at least one track, with pair-wise parallel running rails which has partly enclosed room for the vehicles four side-mounted wheels. The rails are primarily supported by along running beams on posts 140, or otherwise suspended from above. The system is fundamentally for ring-type transport, but can by means of a switching arrangement/active junctions be expanded into a network. The rolling surface of the wheels will be just below the outer floor of the vehicles, so that switching using passive track switching is possible. Switching will primarily be performed by means of a two vehicle guiding mechanisms with accompanying guiding wheels in each vehicle 2 latches onto the right or left guiding rail in a AY junction. The guiding rails are integrated parts of the beams 11,11' in the junction. The design of the vehicle 2 and its positioning with regards to the rails allow the suspension of the vehicle directly on the axles, and allow installing the engine, breaking arrangements and vehicle guiding mechanisms into the vehicle, typically under seats or baggage shelves. The along running beams will be so low that good views will be provided for passengers. The vehicle will have full height for standing passengers, and the reduced weights that the system concept allow, in comparison to known systems, more passengers per vehicle. The use of two parallel beams could appear obvious, but the monorail metaphor has probably got so thoroughly stuck in the community of practice, so that no one deviated from this stereotype. Two beams will probably be more visually intrusive than one. And even though each beam 11,11' in a Skyway system is smaller than the single beam of know systems, visual impact will probably be the main disadvantage. But by bi-directional traffic, the two tracks can share the middle beam so that only three beams would be required. What makes the use of two beams particularly attractive, is that the vehicle 2 will move particularly protected between the beams 11,11'. The vehicle will not be able to overturn or fall down, and will appear very close to a car in its movements. This will cause passengers to accept more vibrations and "bumps" from a Skyway system than they would from other known PRT systems. Further, the wheels roll in a semi-enclosed cavity, screened from ice and snow, an arrangement that will dampen noise and simplify maintenance. In sum, this system concept makes the realisation of a PRT system significantly more affordable and more cost-effective than known systems. These advantages will probably contribute to such a system becoming reality in the foreseeable future, and thereby contribute to increased quality of life and less environmental problems for citizens of larger cities.

What is claimed is:

1. A system for ring-type rail transport for unidirectional movement, comprising:

tracks joined by means of track junctions, said tracks mainly arranged above ground and comprising pairwise parallel rail-shaped rolling surfaces with fixed separation;

load-carrying vehicles with wheels, said tracks above ground comprising carrying beams each having one open railtrack trench along the inwards facing surface of said carrier beams, said railtrack trench having a height larger than a diameter of said wheels, and said rolling surfaces arranged on a lower surface in said railtrack trench, with said carrier beams being carried on top of Y-shaped carrying posts, stations that have starters for transferring energy to said vehicles, and said tracks arranged at ground level having said rolling surfaces being directly on the ground, said vehicles being arranged with said vehicle's cabin running in the space between said carrying beams, said vehicles having a plane outer bottom surface, said wheels being on horizontal axles extending to either side of said vehicles, said sideways extending wheels arranged. to extend into and run in said open railtrack trench, with a lower contact surface of each wheel on the rolling surface being arranged immediately below said outer bottom surface, and with said wheels having an outer flange.

2. The system of claim 1, wherein said vehicles each have only two pairs of said wheels.

3. The system of claim 1, wherein said vehicles comprise an onboard engine above said bottom surface.

4. The system of claim 1, wherein said vehicles comprise windows and said carrying beams have a height lower than said windows.

5. The system of claim 1, wherein said carrying beams further comprise guiding rails that extend into said open side to guide said wheels.

6. The system of claim 5, wherein said vehicles further comprise a guiding mechanism adjacent to one of said wheels that selectively engages said guiding rails to guide said vehicles through track intersections.

7. The system of claim 6, wherein said guiding mechanism comprises a beam at right angles to a direction of travel and having a length about the same as the fixed separation of said rolling surfaces, said beam tilting about an axis to selectively engage one of said guiding rails at a time.

8. A ring-type rail transport system for unidirectional movement, comprising:

plural load-carrying vehicles that each have a cabin with an exterior bottom surface and laterally outward wheels, each of said wheels having a flange on a laterally outward part of a contact surface, a lower part of said contact surface being below said bottom surface;

stations that have starters for transferring energy to said vehicles;

plural above-ground track sections joined with track junctions for transporting said plural vehicles, each of said track sections comprising, a pair of carrying beams, each of said carrying beams having a lower interior surface, an upper interior surface, and an open side between said lower and upper interior surfaces facing said open side of the other of said carrying beams, and a pair of rail-shaped parallel rolling surfaces that are a fixed distance apart and that contact said lower part of said contact surface of respective said wheels, said flanges being laterally outside said rolling surface, each of said rolling surfaces being on said lower interior surface of a respective one of said carrying beams, a diameter of said wheels being less than a distance from a top of said rolling surfaces to said upper interior surfaces of said carrying beams, said vehicle cabins having widths less than said fixed distance; and plural Y-shaped carrying posts elevating said track sections above ground.

9. The system of claim 8, wherein said vehicles each have only two pairs of said wheels.

10. The system of claim 8, wherein said vehicles comprise an onboard engine above said bottom surface.

11. The system of claim 8, wherein said vehicles comprise windows and said carrying beams have a height lower than said windows.

12. The system of claim 8, further comprising additional track sections that are not elevated above ground.

13. The system of claim 8, wherein said carrying beams further comprise guiding rails that extend into said open side to guide said wheels.

14. The system of claim 13, wherein said vehicles further comprise a guiding mechanism adjacent to one of said wheels that selectively engages said guiding rails to guide said vehicles through track intersections.

15. The system of claim 14, wherein said guiding mechanism comprises a beam at right angles to a direction of travel and having a length about the same as the fixed distance, said beam tilting about an axis so that one end of said beam selectively engages one of said guiding rails and the other end of said beam does not engage one of said guiding rails.

* * * * *